US008157558B2

(12) United States Patent
Bellar

(10) Patent No.: US 8,157,558 B2
(45) Date of Patent: Apr. 17, 2012

(54) APPARATUS AND METHOD FOR FORMING A CLAY SLAB

(76) Inventor: David Bellar, Hickory, NC (US)

( * ) Notice: Subject to any disclaimer, the term of this patent is extended or adjusted under 35 U.S.C. 154(b) by 0 days.

(21) Appl. No.: 12/383,537

(22) Filed: Mar. 25, 2009

(65) Prior Publication Data

US 2010/0244320 A1 Sep. 30, 2010

(51) Int. Cl.
*B28B 3/12* (2006.01)

(52) U.S. Cl. ..... 425/394; 425/371; 425/223; 425/329; 425/330; 425/335; 425/471

(58) Field of Classification Search ..... 425/110, 425/112, 363, 406, 182, 189, 193, 425, 429, 425/223, 329, 330, 335, 471, 394, 371
See application file for complete search history.

(56) References Cited

U.S. PATENT DOCUMENTS

| | | | | |
|---|---|---|---|---|
| 1,461,563 | A * | 7/1923 | Schmiedeknecht | 264/319 |
| 2,528,311 | A * | 10/1950 | Hurley | 434/420 |
| 2,869,174 | A * | 1/1959 | Hartesveldt | 425/389 |
| 4,238,178 | A | 12/1980 | Bailey | |
| 4,256,448 | A | 3/1981 | Carle | |
| 5,204,123 | A | 4/1993 | Hayashi | |
| 5,498,433 | A | 3/1996 | Ouellette | |
| 7,007,737 | B2 | 3/2006 | Alexin | |
| 7,211,206 | B2 * | 5/2007 | Brown et al. | 264/46.2 |

OTHER PUBLICATIONS

New! Active Slab Roller; www.dickblick.com/products/activa-slab-roller; Jan. 24, 2009; 2 pages.
Brent SR-14 Slab Roller; www.dickblick.com/products/brent-sr-14-roller; Jan. 24, 2009; 2 pages.
Bailey Minimight Slab Roller; www.dickblick.com/products/bailey-minimight-slab-roller; Jan. 24, 2009; 2 pages.
Amaco Mini T-4 Slab Roller; www.dickblisk/products/amaco-mini-t-4-slab-roller; Jan. 24, 2009; 2 pages.

* cited by examiner

*Primary Examiner* — Christina Johnson
*Assistant Examiner* — Saeed Huda
(74) *Attorney, Agent, or Firm* — Christopher C. Dremann, P.C.

(57) ABSTRACT

An apparatus and method for forming a clay slab includes a frame, a front panel supported on the frame and a rear panel supported on the frame. An outer cable is attached to the rear panel at one end and to the rear panel and to the front panel at another end. A rotatable drive axle is configured to simultaneously wind and unwind the outer cable and thereby move the front panel and the rear panel from an initial position to an intermediate position to draw a block of prepared clay into a gap defined by the front panel and the rear panel. The drive axle is further configured to simultaneously wind and unwind the outer cable in the opposite direction and thereby move the front panel and the rear panel from the intermediate position back to the initial position to remove the clay slab from the slab roller.

19 Claims, 20 Drawing Sheets

APPARATUS AND METHOD FOR FORMING A CLAY SLAB

BACKGROUND OF THE INVENTION

The invention relates to an apparatus and method for forming a clay slab. More particularly, the invention is a slab roller and an associated method for working prepared clay into a relatively flat clay slab having a generally uniform thickness of the type used in making clay pottery, sculpture and artwork. In a preferred embodiment, the invention is a slab roller that is oriented in a vertical direction. In another preferred embodiment, the invention is a slab roller configured to draw prepared clay between opposed panels of a flexible material to form a relatively flat clay slab having a generally uniform thickness.

Clay used in making pottery, sculpture and artwork is typically cut from a large block of prepared clay and worked (also referred to as "molded") into a relatively flat clay slab having a generally uniform thickness. Various equipment and techniques are employed for working the clay depending on the desired size, shape and uniformity of the clay slab. Smaller clay slabs may be formed by hand using a rolling pin on a flat surface, such as a table top or counter, with or without guide rails for controlling the thickness of the clay slab. An example of a known apparatus for forming a clay slab by hand is commercially available under the trade name Activa® Slab Roller and includes a 10.5 inch rolling pin, a rolling board and a plurality of rails for forming clay slabs having various generally uniform thicknesses. Larger clay slabs are typically formed using a manually-operated slab roller machine mounted on a frame. In some instances, the rollers of the slab roller machine may be power-driven, for example by an electrical motor. Commercially available examples of power-driven slab roller machines include the Bailey™ tabletop Minimight™ A Slab Roller, the convertible Brent® SR-14 Slab Roller and the portable Amaco® Mini T-4 Slab Roller.

Regardless, all known slab rollers have the disadvantage that the slab roller is oriented in a horizontal direction so as to work the prepared clay and form the clay slab on a horizontal surface, such as a tabletop, counter or elongated workspace of the slab roller. However, a slab roller oriented in a horizontal direction occupies a substantial amount of floor space, which in most pottery, sculpture and artwork workshops is limited. Although some slab rollers are configured to be moved from a horizontal orientation for working to a vertical orientation for storage, such slab rollers still require a substantial amount of floor space while forming the clay slab and furthermore require an additional expenditure of manpower and time to convert the slab roller from the horizontal orientation to the vertical orientation. A horizontally oriented slab roller also provides no mechanical advantage to the process of molding the prepared clay into a relatively flat clay slab having a generally uniform thickness. In particular, feeding the prepared clay into the slab roller is not assisted by gravity. To the contrary, gravity works against the molding process with a conventional slab roller since the clay slab tends to bunch up as the weight of the prepared clay exiting the rollers experiences increasing friction with the horizontal table.

Another disadvantage of the known slab rollers is that one or more rollers are driven by a complex arrangement of cranks, gears, cables or the like, directly over the prepared clay. The driven rollers operate to apply a pushing force to the prepared clay, similar to a rolling pin, to form the generally planar clay slab. In many instances, a drive board or a panel of flexible material, such as a relatively thin sheet of plastic or canvas, is placed between the roller and the clay, or between the horizontal surface and the clay, to prevent adhesion of the clay to the rollers and the horizontal surface. The roller may also be knurled or provided with a roughened exterior surface so as to grip the sheet of flexible material or drive board in a positive manner. The use of a driven roller to drive the clay often results in the clay slab having an undesirable grain direction and/or an uneven or rough exterior surface. A predetermined grain direction is undesirable because non-isotropic stress patterns can develop in the work piece during firing and subsequent quenching, which may cause the finished piece to shift or warp. A clay slab having an uneven or rough exterior surface can result in the finished piece of clay pottery, sculpture or artwork having an undesirable exterior surface.

Other shortcomings and disadvantages inherent in slab rollers oriented in a horizontal direction include the tendency for complicated gearboxes that transfer force from the crank to the rollers to wear out, fail or require frequent adjustment. In addition, the known slab rollers include inferior adjustment mechanisms for adjusting the distance between the driven rollers, and consequently, the thickness of the clay slab. Adjustment mechanisms for existing slab rollers are not synchronized, and thus, do not always produce a clay slab having a generally uniform thickness. Furthermore, the panels of flexible material (e.g. canvas fabric) utilized with most existing slab rollers are not integrally formed or attached to one another in any manner. Accordingly, the panels must first be located, arranged on the slab roller and aligned, resulting in a significant expenditure of set-up time before the clay slab can be formed. If the driven rollers are not adjusted accurately, or the loose canvas fabric is not positioned properly and carefully aligned, the prepared clay may tend to wander off to one side, thereby requiring the clay slab to be re-formed and resulting in a further expenditure of time.

Accordingly, there exists an unresolved need for an apparatus and method for forming a clay slab that overcomes the disadvantages of known slab rollers and associated methods. More specifically, there exists a need for a slab roller for working prepared clay into a relatively flat clay slab having a generally uniform thickness of the type used in making clay pottery, sculpture and artwork. There exists a particular need for a slab roller that is not oriented in a horizontal direction so as to work prepared clay and form a clay slab on a horizontal surface, such as a tabletop, counter or elongated workspace of the slab roller. There also exists a particular need for a slab roller that does not utilize one or more driven rollers to drive prepared clay between panels of a flexible material, such as a relatively thin sheet of plastic or canvas, to form a clay slab.

BRIEF SUMMARY OF THE INVENTION

The aforementioned needs, objectives and advantages, as well as others that will be readily apparent to those of ordinary skill in the art, are provided by an apparatus and method for forming a relatively flat clay slab having a generally uniform thickness of the type used in making clay pottery, sculpture and artwork.

In one aspect, the invention is embodied by an apparatus for forming a clay slab including a frame, a first panel supported on the frame and a second panel supported on the frame. The first panel and the second panel defining a gap therebetween for forming the clay slab with the frame oriented in a vertical direction.

In a preferred embodiment, the first panel and the second panel are configured for movement in a vertical direction to form the clay slab. More particularly, the first panel and the second panel are configured for movement from an initial position to an intermediate position and from the intermediate position back to the initial position.

In another preferred embodiment, the first panel and the second panel are supported on the frame by at least one cable and the apparatus further includes a drive axle configured for rotation to simultaneously wind and unwind the at least one cable about the drive axle. The apparatus may include a handle rigidly connected to the drive axle for manually rotating the drive axle.

In another preferred embodiment, the at least one cable comprises a pair of outer cables, each of the outer cables attached to a first shaft supporting a first end of the second panel at a first end of the outer cable and attached to a second shaft supporting a second end of the second panel and a first end of the first panel at a second end of the outer cable.

In another preferred embodiment, the apparatus further includes an inner cable attached to the second shaft supporting the second end of the second panel and the first end of the first panel at a first end of the inner cable and attached to a third shaft supporting a second end of the first panel at a second end of the inner cable. Each of the outer cables and the inner cable may be routed through at least one pulley provided on the frame.

In another preferred embodiment, the apparatus further includes a first idler roller for applying pressure to the first panel during movement of the first panel on the frame and a second idler roller for applying pressure to the second panel during movement of the second panel on the frame. An adjustment mechanism may be provided for adjusting the distance between the first idler roller and the second idler roller to thereby determine the gap between the first panel and the second panel. The adjustment mechanism may include an actuator rigidly connected to a screw drive with one of the first idler roller and the second idler roller movably coupled to the screw drive. Furthermore, the adjustment mechanism may include a first actuator rigidly connected to a first screw drive with the one of the first idler roller and the second idler roller movably coupled to the first screw drive, and a second actuator rigidly connected to a second screw drive with the one of the first idler roller and the second idler roller movably coupled to the second screw drive. The first actuator and the second actuator, or the first screw drive and the second screw drive, may be operatively coupled to simultaneously move the one of the first idler roller and the second idler roller relative to the other of the first idler roller and the second idler roller.

In another preferred embodiment, the apparatus further includes a third panel that is movable between a first configuration wherein a first end of the third panel is fixedly attached to a first end of the first panel and removably attached to a second end of the first panel, and a second configuration wherein the first end of the third panel is removably attached to a first end of the second panel and fixedly attached to a second end of the second panel.

In another preferred embodiment, the apparatus further includes a stop mechanism for retaining the first panel and the second panel in a predetermined position. The stop mechanism may include a stop configured for movement between an unlocked position and a locked position wherein the stop is in locking engagement with the frame.

In another aspect, the invention is embodied by a method for forming a clay slab utilizing a slab roller including a frame, a first panel supported on the frame and a second panel supported on the frame, the first panel and the second panel defining a gap therebetween. The method further includes positioning a block of prepared clay adjacent the gap between the first panel and the second panel with the slab roller in an initial position. The method further includes moving the first panel and the second panel of the slab roller from the initial position to an intermediate position to draw the block of prepared clay into the slab roller between the first panel and the second panel. The method further includes moving the first panel and the second panel of the slab roller from the intermediate position back to the initial position with the clay slab disposed on the second panel and thereafter removing the clay slab from the second panel.

In a preferred embodiment of the method, moving the first panel and the second panel from the initial position to the intermediate position and moving the first panel and the second panel from the intermediate position back to the initial position further includes rotating a drive axle to simultaneously wind and unwind at least one cable attached to a first end of the first panel and attached to a first end and a second end of the second panel.

In another preferred embodiment of the method, the frame, the first panel and the second panel of the slab roller are oriented in a vertical direction and the block of prepared clay is positioned adjacent the gap defined by the first panel and the second panel under the influence of gravity.

In yet another aspect, the invention is embodied by a slab roller for forming for forming a relatively thin clay slab having a generally uniform thickness. The slab roller includes a frame oriented in a vertical direction and including a pair of side frame members, a lower frame member and an upper frame member, the frame defining a central opening. The apparatus further includes a front panel disposed within the central opening and having a forward end and a rearward end. The apparatus further includes a rear panel disposed within the central opening and having a rearward end and a forward end operatively coupled to the rearward end of the front panel. The apparatus further includes at least one outer cable having an end attached to the rearward end of the rear panel and another end attached to the forward end of the rear panel and to the rearward end of the front panel. The apparatus further includes an inner cable having an end attached to the forward end of the front panel and another end attached to the rearward end of the front panel. The apparatus further includes a drive axle rotatably supported on the frame and configured to simultaneously wind and unwind the at least one outer cable about the drive axle and thereby move the front panel and the rear panel from an initial position wherein a block of prepared clay is disposed adjacent a gap defined between the front panel and the rear panel to an intermediate position wherein the block of prepared clay is drawn into the slab roller between the front panel and the rear panel. The drive axle is further configured to simultaneously wind and unwind the at least one outer cable about the drive axle in the opposite direction and thereby move the front panel and the rear panel from the intermediate position back to the initial position wherein the clay slab is disposed on one of the front panel and the rear panel.

BRIEF DESCRIPTION OF THE DRAWINGS

The invention is best understood by reference to the following detailed description taken in conjunction with the accompanying drawing figures in which.

DETAILED DESCRIPTION OF THE INVENTION

Figure 1A:
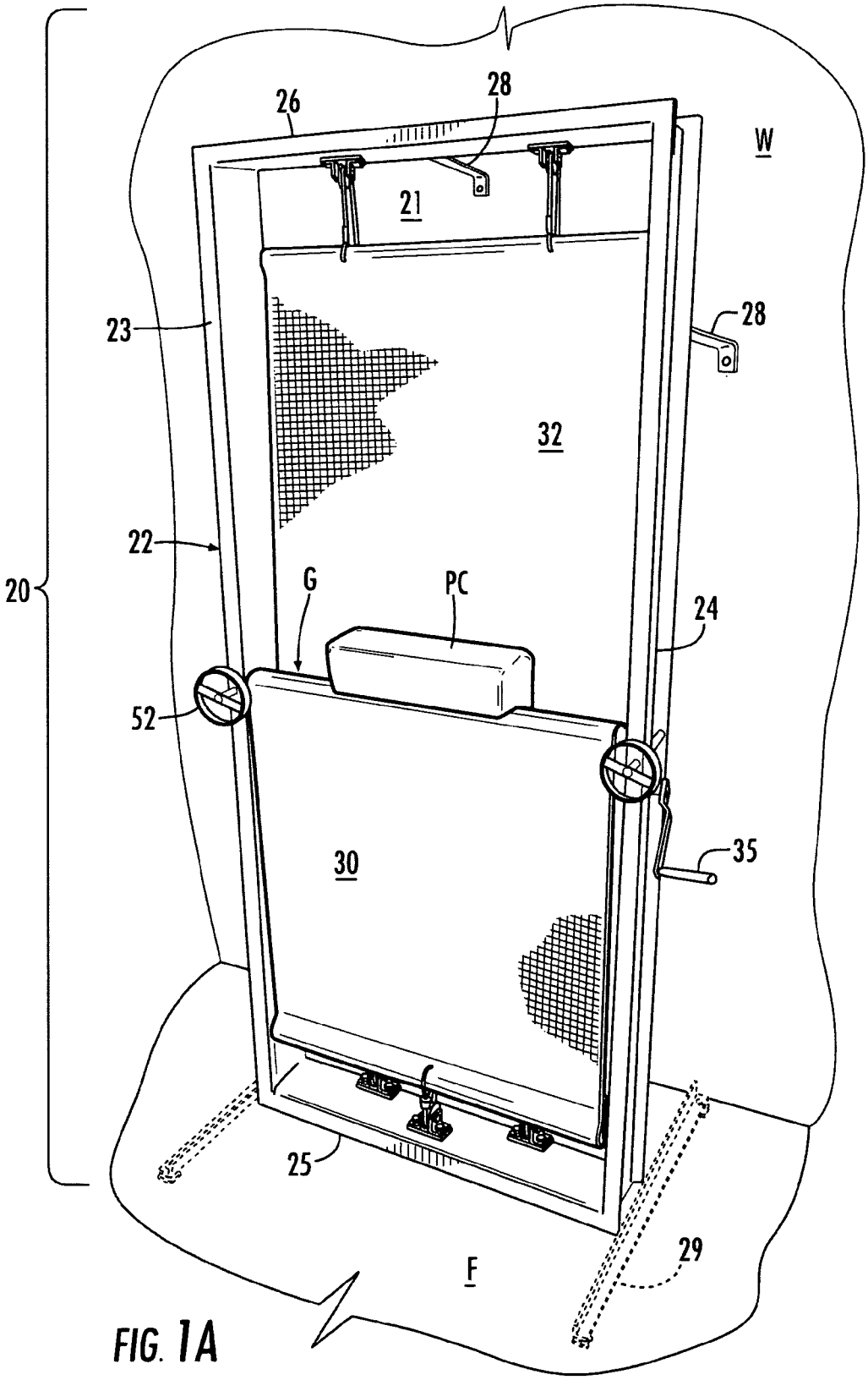
FIG. 1A is a front perspective view of an apparatus for forming a clay slab according to the invention showing a block of prepared clay positioned for feeding into a slab roller oriented in a vertical direction with the slab roller in an initial position.

Referring now to the accompanying drawing figures in which identical reference numerals denote the same or similar elements throughout the various views, an apparatus for forming a clay slab according to the invention is shown. The apparatus, also referred to herein as the "slab roller" and indicated generally at 20, is operable for working prepared clay to form a relatively flat clay slab having a generally uniform thickness of the type used for making clay pottery, sculpture and artwork. The apparatus comprises a frame 22 oriented in a vertical direction relative to a horizontal floor F and a vertical wall W (or other support) of a work space in, for example, a pottery shop or art studio. As shown, the frame 22 includes a pair of spaced apart side frame members 23, 24 separated by a lower frame member 25 adjacent the floor F and an upper frame member 26 vertically spaced from the lower frame member. Each of the frame members 23, 24, 25, 26 is preferably made of metal and formed as an elongate beam having a generally u-shaped cross-section, for example by casting, bending or extruding. The u-shaped cross-section provides bending and torsional stiffness, as well as other advantages that will be described or will be readily apparent to one of ordinary skill. The frame members 23, 24, 25, 26 may be joined together in any suitable manner, for example by welding or by mechanical fasteners, as desired.

Regardless, the frame members 23, 24, 25, 26 form a generally rectangular frame 22 oriented in a vertical direction having vertical side frame members 23, 24 that are significantly longer than the horizontal lower frame member 25 and the horizontal upper frame member 26. Thus, the frame 22 is configured to support the primary components of the slab roller for forming a clay slab, as will be described, within a central opening 21 defined by the frame members 23, 24, 25, 26. The frame 22 may be free-standing, or may be secured to the wall W by one or more conventional brackets 28. If desired, the brackets 28 may be configured to be movable (e.g. slidable) along the frame members in a suitable manner so as to be positioned at any convenient location for securing the frame 22 to the wall W. Alternatively or in addition, the frame 22 may be provided with one or more optional foot rails 29 for securing the frame 22 to the floor F, for example with an adhesive, mechanical fasteners or the like. Still further, the frame 22 or the optional foot rails 29 may be provided with wheels, roller, castors or the like for permitting the slab roller 20 to be readily moved from one area of the work space to another, or for convenient storage adjacent the work space, for example in a closet or storage room. Orienting the slab roller 20 in a vertical direction as opposed to a horizontal direction, such as on a tabletop, counter or elongate horizontal frame, results in the slab roller having a significantly smaller footprint on the floor F, and thus, occupying substantially less of the available work space. Orienting the slab roller 20 in a vertical direction also provides a significant mechanical advantage and a substantial increase in speed for forming a clay slab from a block of prepared clay, as will be described. Thus, the apparatus and the method of the invention provide space savings and time savings with reduced effort, as well as the accompanying reduction in complexity, reliability and cost savings.

Figure 1B:
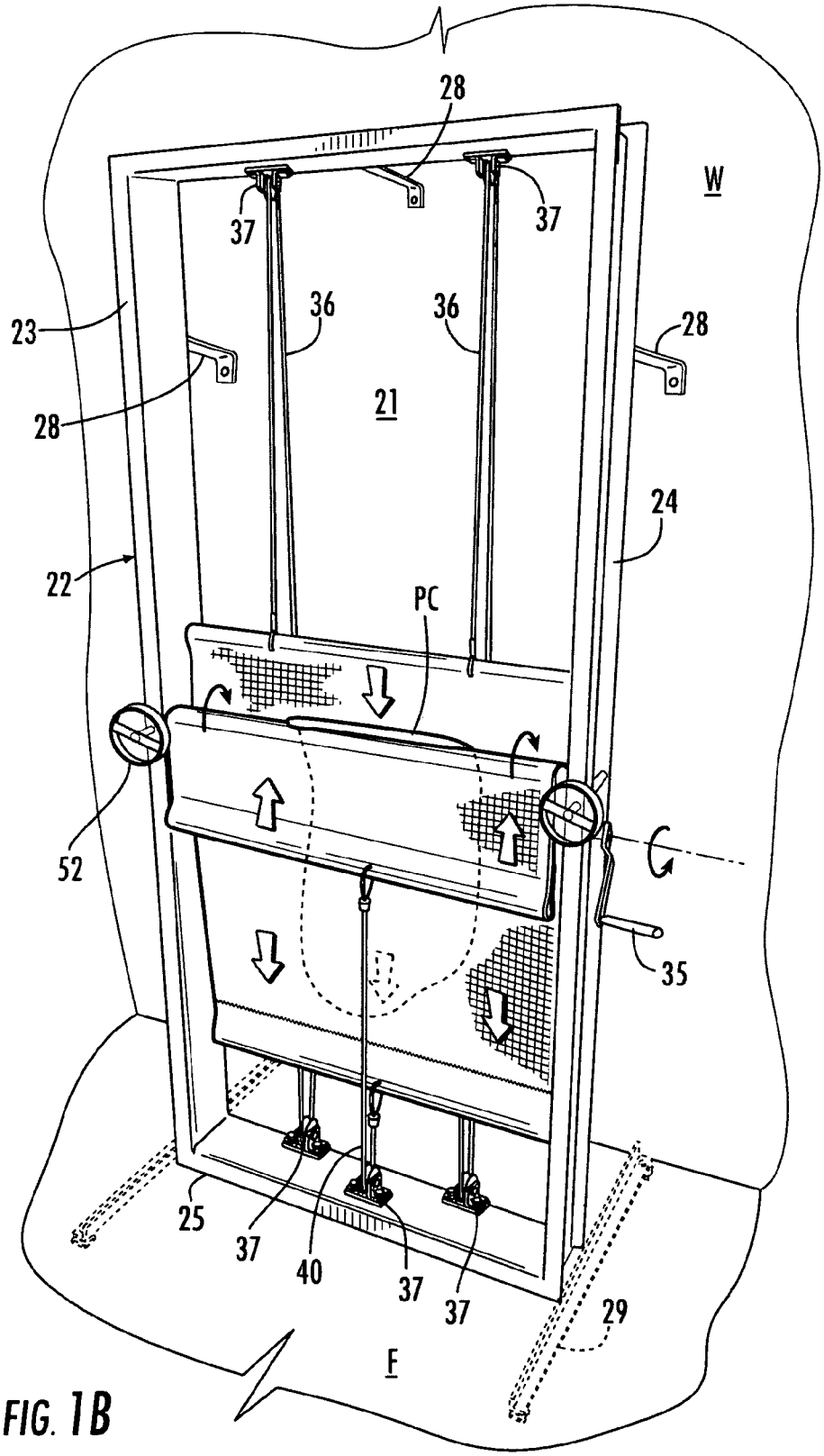
FIG. 1B is another front perspective view of the apparatus showing the prepared clay drawn into the slab roller with the slab roller in an intermediate position.
Figure 1C:
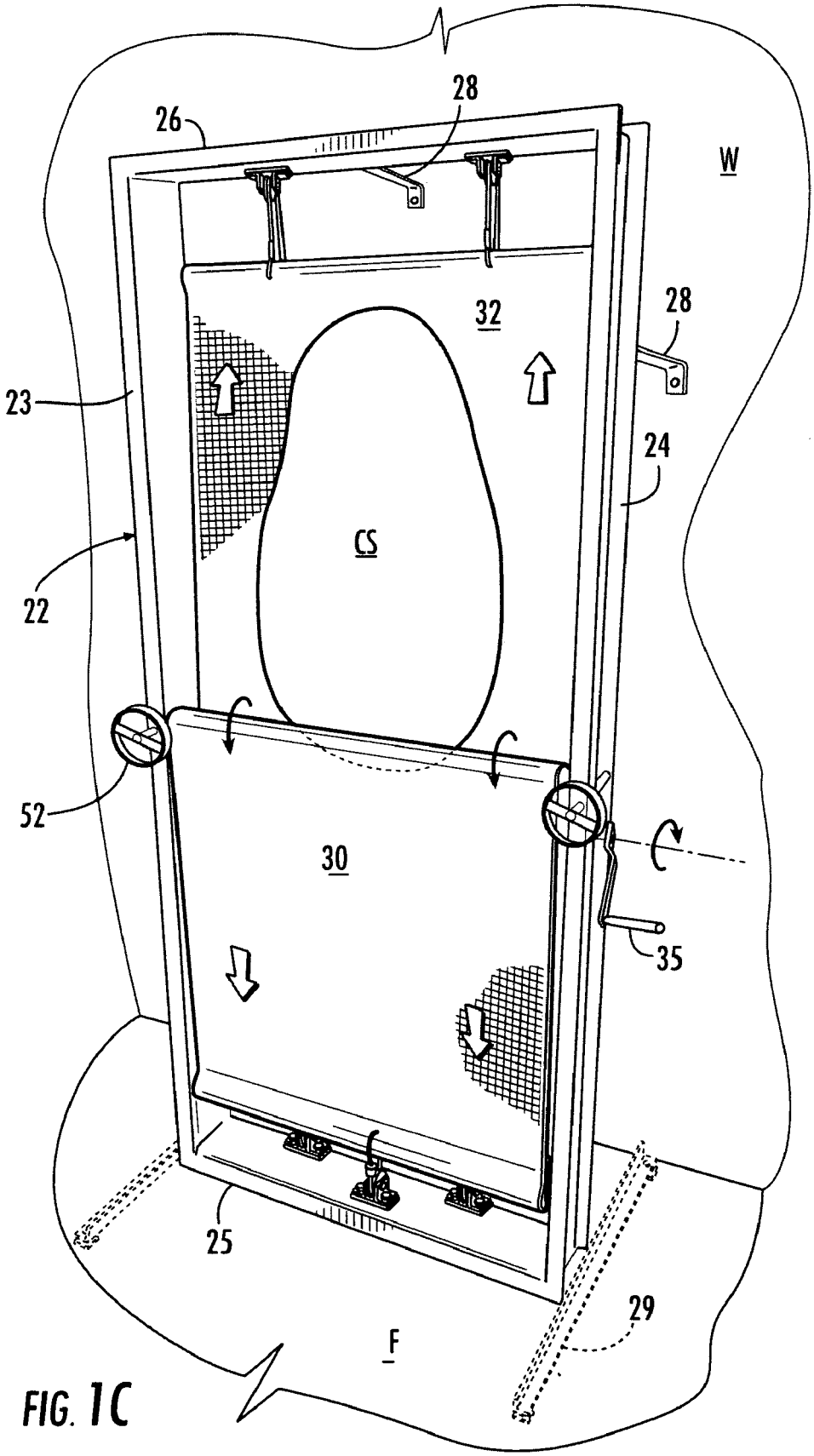
FIG. 1C is another front perspective view of the apparatus showing the formed clay slab with the slab roller back in the initial position.

As will be described in greater detail, the slab roller 20 is configured to move between an initial position shown in FIG. 1A and an intermediate position shown in FIG. 1B, and to return from the intermediate position back to the initial position shown in FIG. 1C. FIG. 1A illustrates a block of prepared clay PC positioned for feeding into the slab roller 20 in a vertical direction with the slab roller in the initial position. The prepared clay PC is held under the influence of gravity above a predetermined gap G between a front panel 30 and a rear panel 32 of the slab roller 20. Preferably, the front panel 30 and the rear panel 32 are each made of a flexible material, such as a relatively thin sheet of plastic or canvas. The gap G is determined by the distance between a generally cylindrical, horizontal front idler roller 31 spaced apart from a generally cylindrical, horizontal rear idler roller 33, as will be described with reference to FIGS. 4A-4C and FIGS. 5A-5C. FIG. 1B illustrates the prepared clay PC disposed between the front panel 30 and the rear panel 32 with the slab roller 20 in the intermediate position. FIG. 1C shows the clay slab CS positioned to be removed from the rear panel 32 with the slab roller 20 returned to the initial position. A handle 35 is provided adjacent one of the side frame members 23, 24 of the frame 22 for rotating a horizontal drive axle 34 (FIG. 2) to wind and unwind a pair of outer cables 36 routed through pulleys 37 and attached to horizontal shafts 38, 39 (e.g. FIG. 4A) supporting the rearward and forward ends, respectively, of the rear panel 32. An inner cable 40 (FIG. 1B) medially disposed between outer cables 36 is routed through a pulley 37 and attached at one end to horizontal shaft 39, which supports the rearward end of front panel 30 in addition to the forward end of rear panel 32. The other end of inner cable 40 is attached to a horizontal shaft 41 supporting the forward end of front panel 30.

Figure 2:
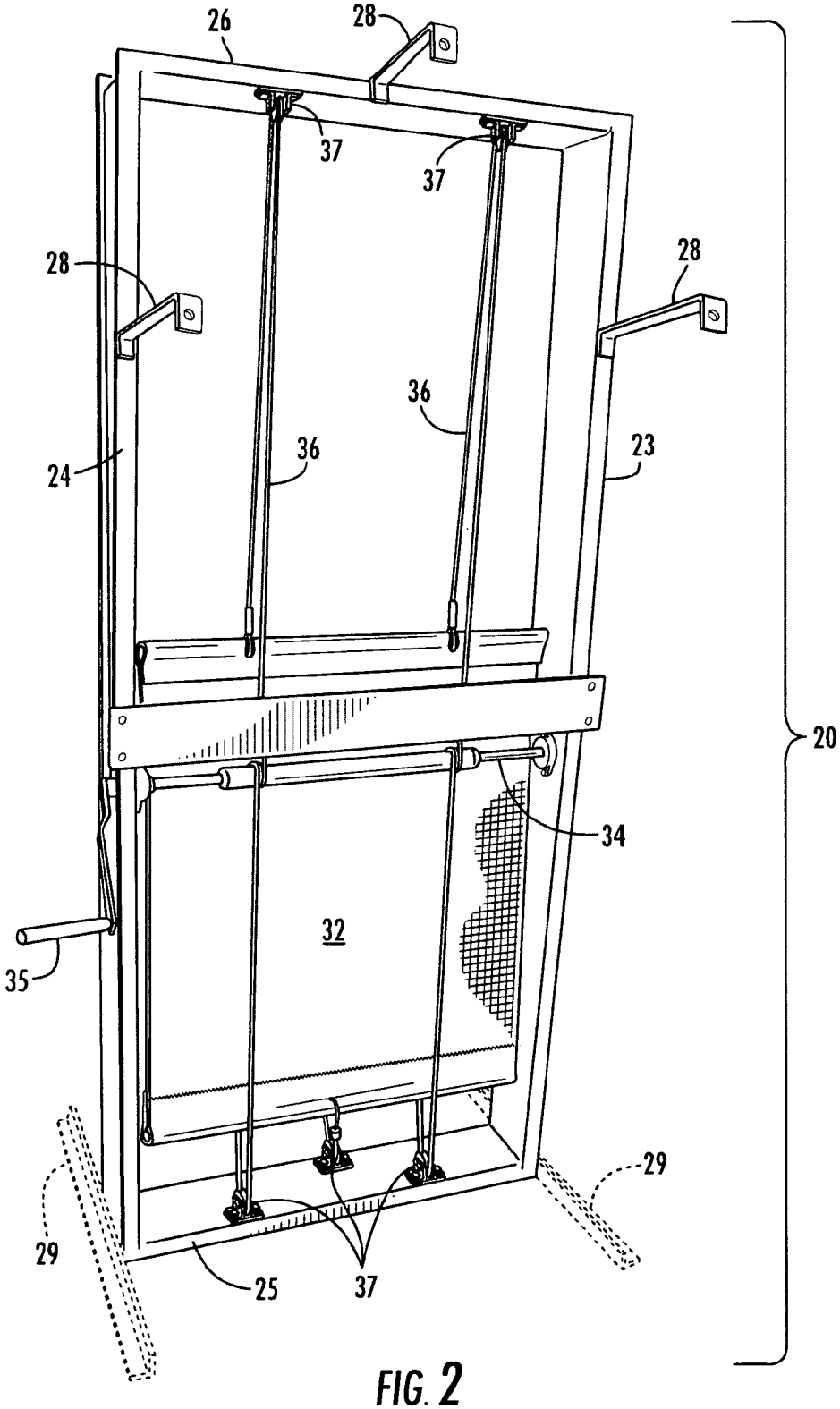
FIG. 2 is a rear perspective view of the apparatus showing the slab roller in the intermediate position of FIG. 1B.
Figure 4A:
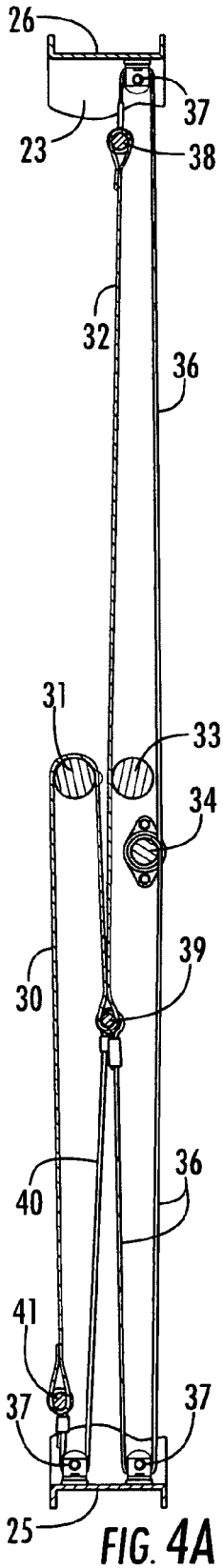
FIG. 4A is a sectional view of the apparatus taken in the direction indicated by 4A-4A in FIG. 3A with the slab roller in the initial position.
Figure 4B:
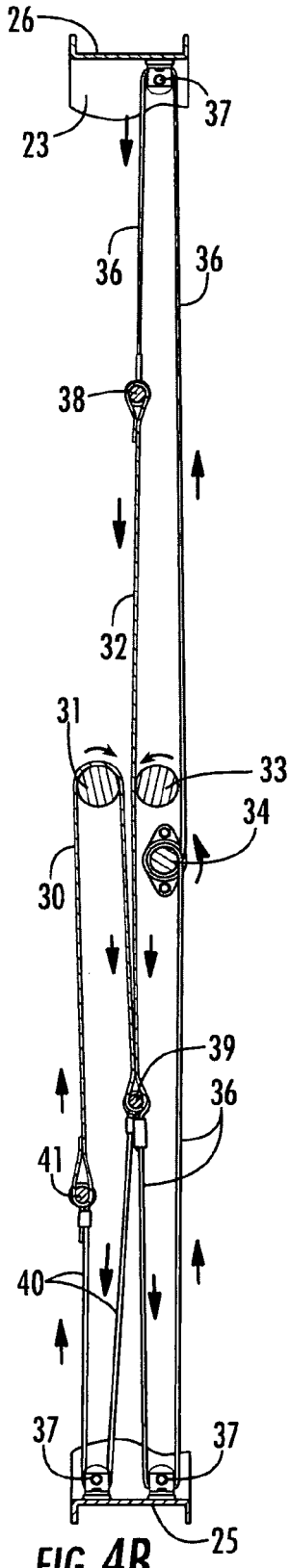
FIG. 4B is a sectional view of the apparatus taken in the direction indicated by 4B-4B in FIG. 3B illustrating the slab roller moving from the initial position to the intermediate position.
Figure 4C:
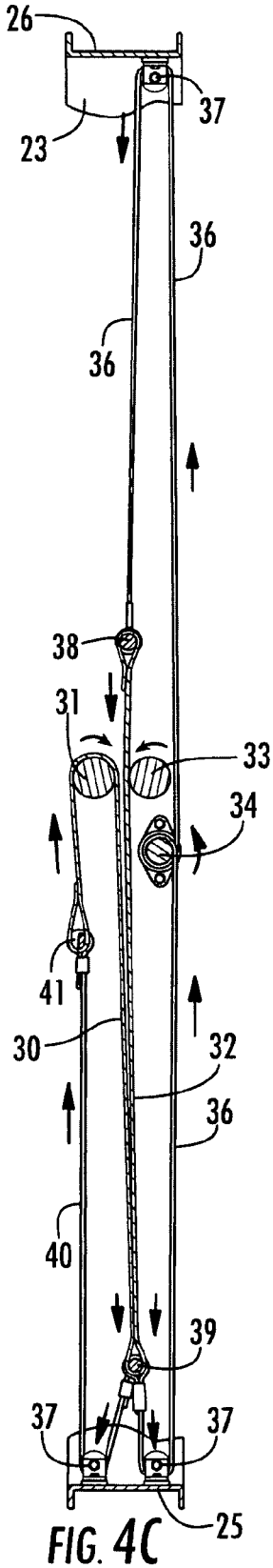
FIG. 4C is a sectional view of the apparatus taken in the direction indicated by 4C-4C in FIG. 3C and FIG. 3D with the slab roller in the intermediate position.
Figure 5A:
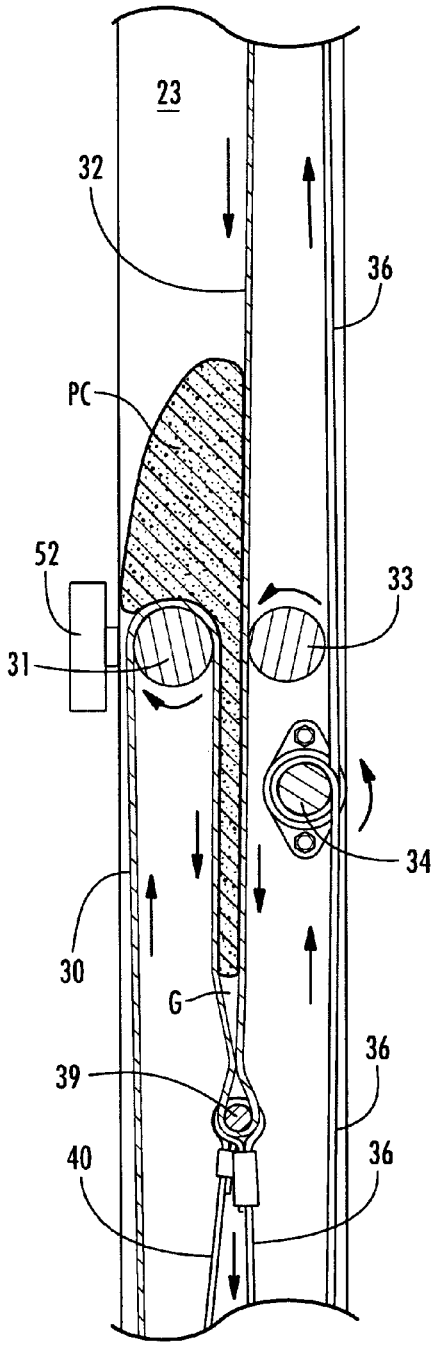
FIG. 5A is an enlarged sectional view illustrating a method for forming a clay slab according to the invention wherein the prepared clay is drawn into the slab roller between the front panel and the intermediate panel while the slab roller is moving from the initial position towards the intermediate position.
Figure 5B:
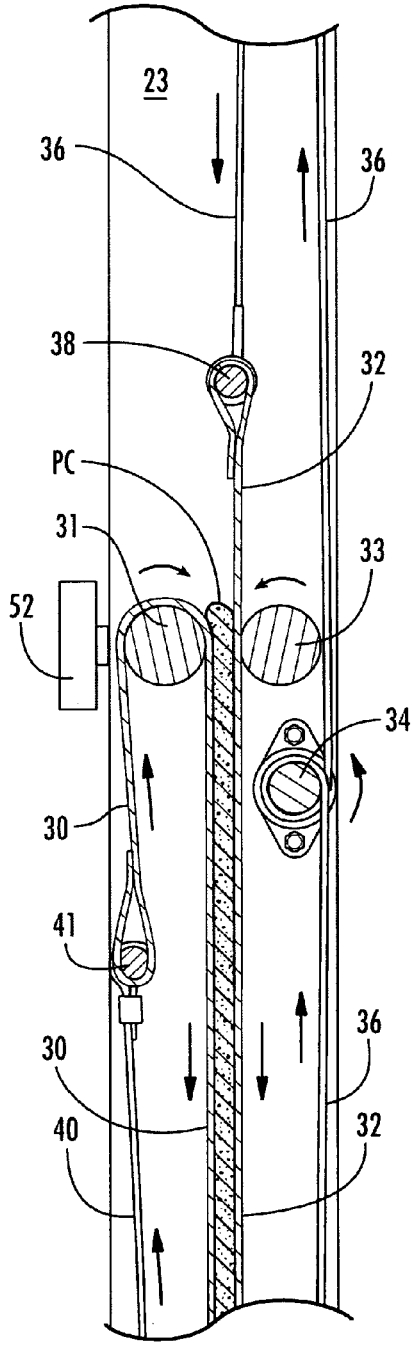
FIG. 5B is an enlarged sectional view illustrating the method wherein the prepared clay is disposed between the front panel and the intermediate panel with the slab roller in the intermediate position.
Figure 5C:
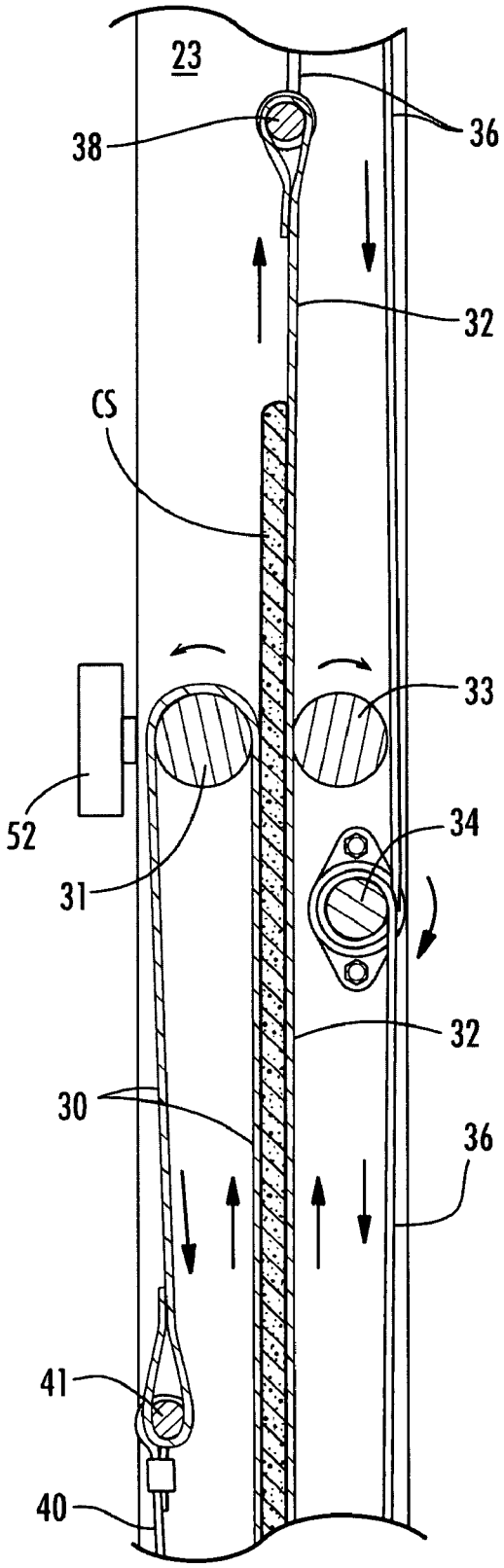
FIG. 5C is an enlarged sectional view illustrating the method wherein the prepared clay is partially disposed between the front panel and the intermediate panel while the slab roller is moving from the intermediate position back to the initial position.

FIG. 2 shows the slab roller 20 in the initial position from the rear. Movement of the slab roller 20 from the initial position to the intermediate position and back again to the initial position to form a relatively flat clay slab CS having a generally uniform thickness will be described with reference to FIGS. 3A-3F. FIGS. 4A-4C illustrate the operation of drive axle 34, outer cables 36, inner cable 40, front idler roller 31 and rear idler roller 33 in response to rotation of handle 34 moving the slab roller 20 from the initial position to the intermediate position and back again to the initial position. FIGS. 5A-5C illustrate a method for forming the clay slab CS from the prepared clay PC according to the invention wherein the slab roller 20 is moved from the initial position to the intermediate position and back again to the initial position.

Figure 3A:
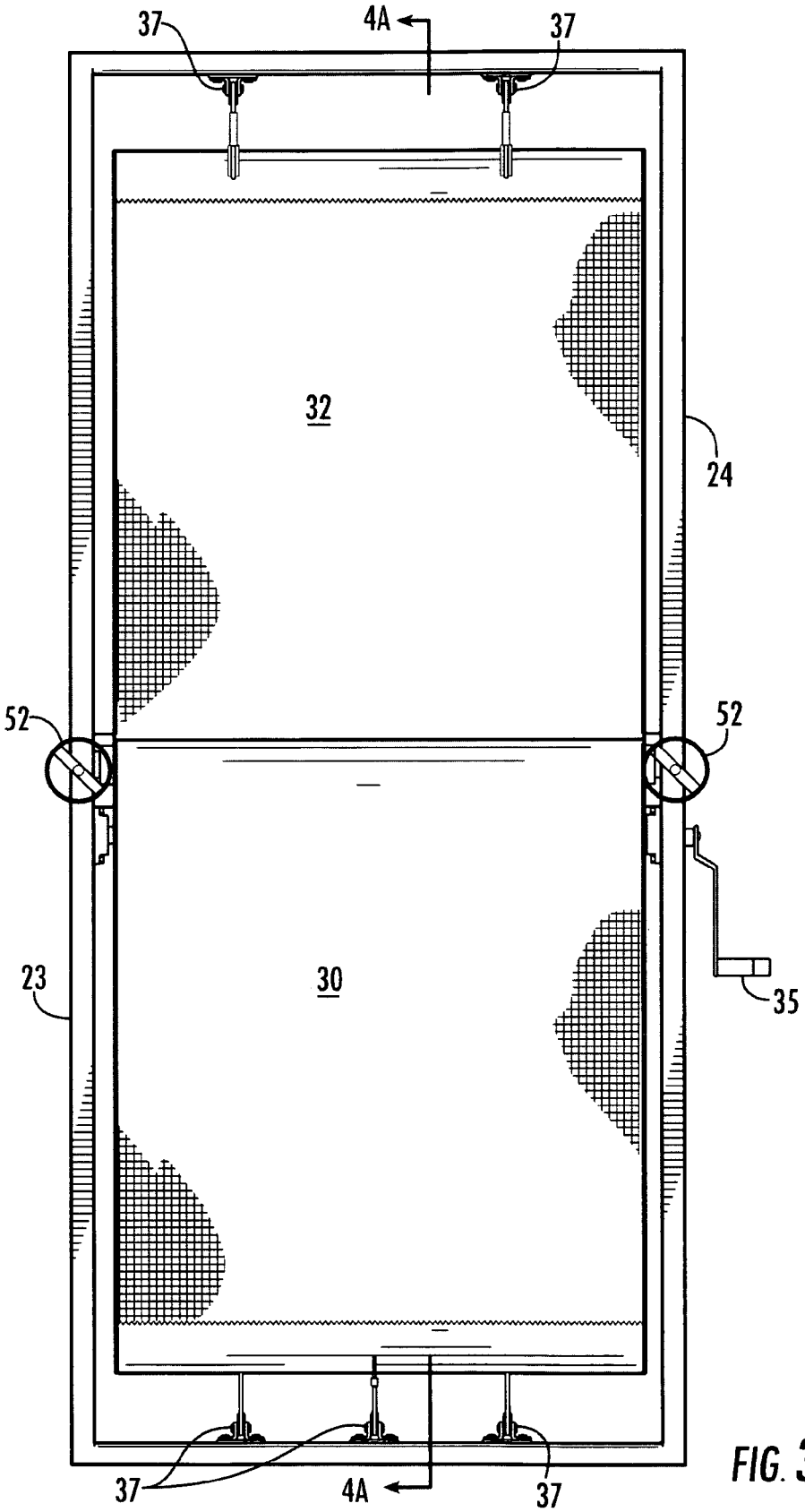
FIG. 3A is a front elevation view of the apparatus with the slab roller in the initial position.

As shown in FIG. 3A, the front panel 30 of the slab roller 20 is disposed fully downward and the rear panel 32 is disposed fully upward in the initial position. In the initial position, the shaft 41 supporting the forward end of the front panel 30 is attached to an end of the inner cable 40 adjacent the lower pulleys 37 with the inner cable 40 routed around the inner pulley 37. Similarly, the shaft 38 supporting the rearward end of the rear panel 32 is attached to ends of the outer cables 36 adjacent the upper pulleys 37 with the outer cables 36 routed around the pulleys 37. At the same time, shaft 39 supports both the rearward end of the front panel 30 and the forward end of the rear panel 32 adjacent the drive axle 34 (FIG. 4A and FIG. 5A). The shaft 39 is attached to the other end of the inner cable 40 to coordinate movement of the front panel 30, and is attached to the other ends of the outer cables 36 to coordinate movement of the rear panel 32. In the initial position, the shaft 39 is located below the front idler roller 31 and the rear idler roller 33 so as to define the gap G (FIG. 1A) for feeding a block of prepared clay PC into the slab roller 20.

Figure 3B:
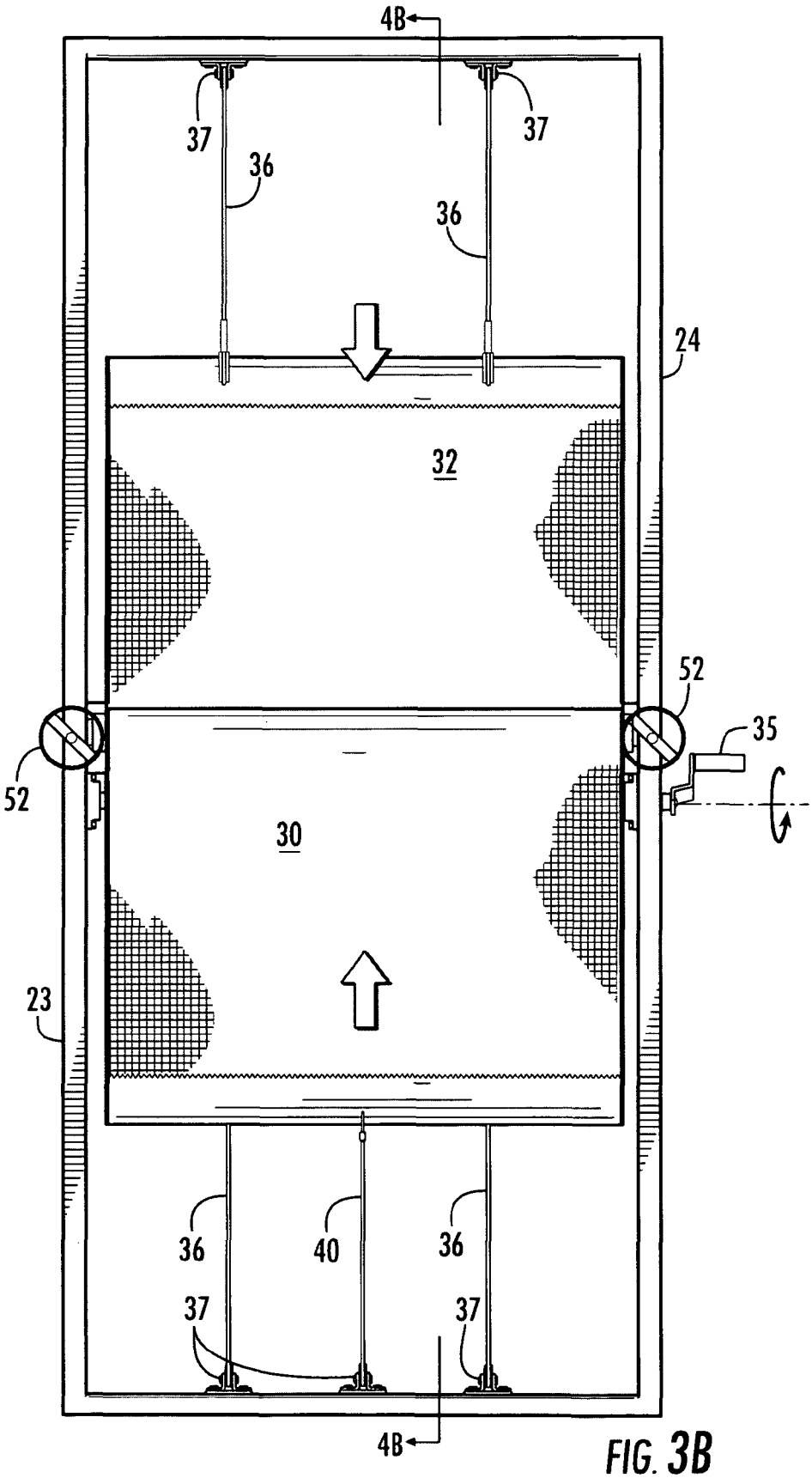
FIG. 3B is a front elevation view of the apparatus illustrating the slab roller moving from the initial position towards the intermediate position.

Once the block of prepared clay PC has been properly positioned for feeding, an operator manually turns the handle 35 in the direction (i.e. counter-clockwise) indicated by the arrow in FIG. 3B. As illustrated in FIG. 4B, turning the handle 35 rotates the drive axle 34 and causes outer cables 36 to simultaneously wind onto and to unwind off the drive axle. As a result, outer cables 36 apply a force to shaft 39 that moves rear panel 32 in the direction (i.e. downward) indicated by the arrows. At the same time, the force applied to shaft 39 moves the rearward end of front panel 30 in the direction (i.e. downward) indicated by the arrow and the forward end of the front panel 30 in the direction (i.e. upward) indicated by the arrow. It should be noted that inner cable 40 is not driven by the drive axle 34, and instead merely guides the front panel 30, while maintaining it substantially taut. Furthermore, it should be noted with reference to FIG. 5A that front idler roller 31 and rear idler roller 33 are not directly driven by the operator turning handle 35. Instead, idler roller 31 merely applies pressure to the front panel 30 and idler roller 33 merely applies pressure to rear panel 32 during movement of the front and rear panels, respectively. As a result, the block of prepared clay PC is not driven into the gap G by the idler rollers 31, 33, and instead is drawn (e.g. pulled) into the gap G by the downward movement of front panel 30 and rear panel 32. Thus, the clay slab CS formed from the prepared clay PC does not exhibit a predetermined grain direction. Furthermore, there is no need to provide the front idler roller 31 or the rear idler roller 33 with a knurled or roughened exterior surface to grip the front panel 30 or the rear panel 32, respectively, in a positive manner. Thus, the clay slab CS will not have an uneven or rough exterior surface that can result in a finished piece of pottery, sculpture or artwork having an undesirable exterior surface.

Figure 3C:
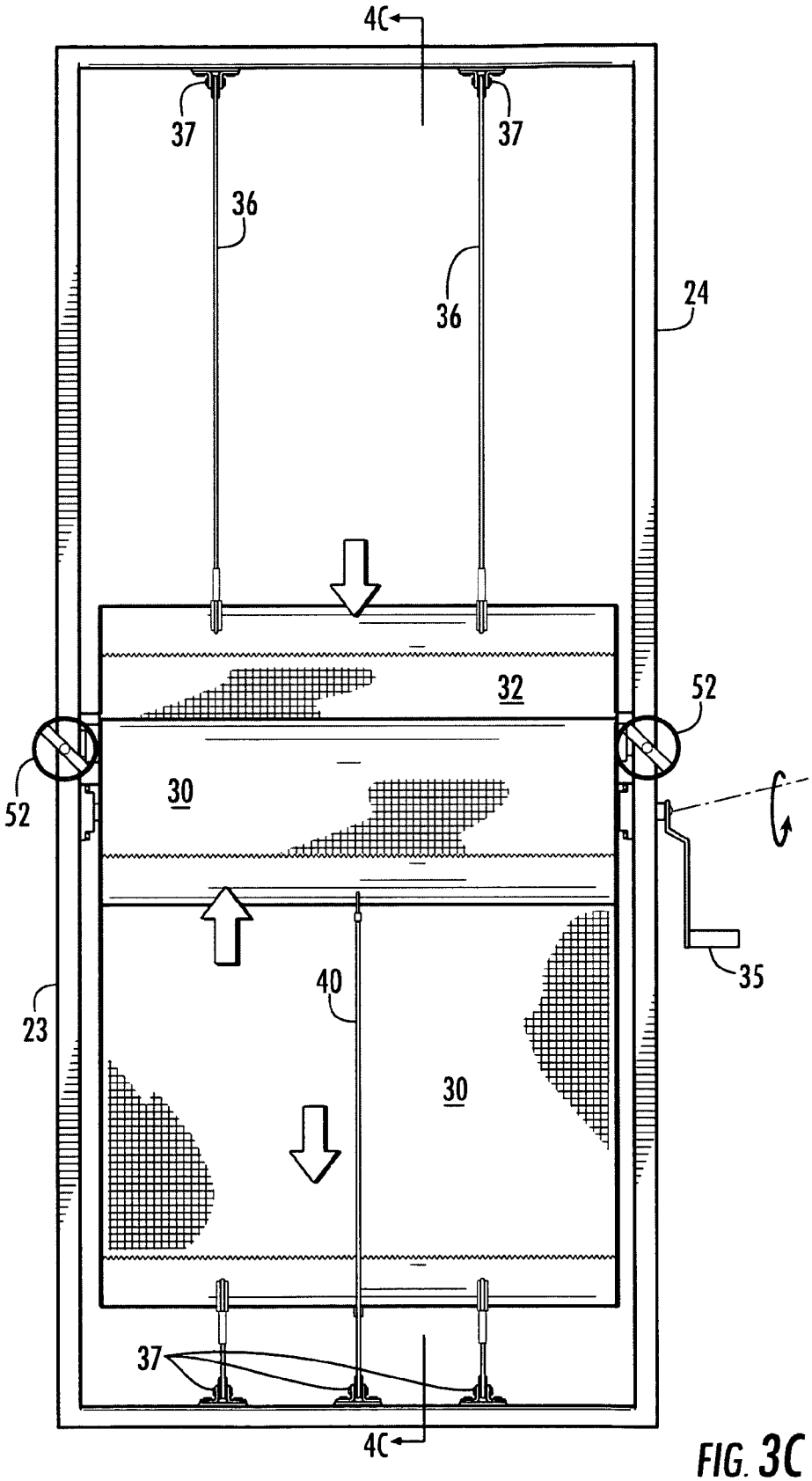
FIG. 3C is a front elevation view of the apparatus with the slab roller in the intermediate position.
Figure 3D:
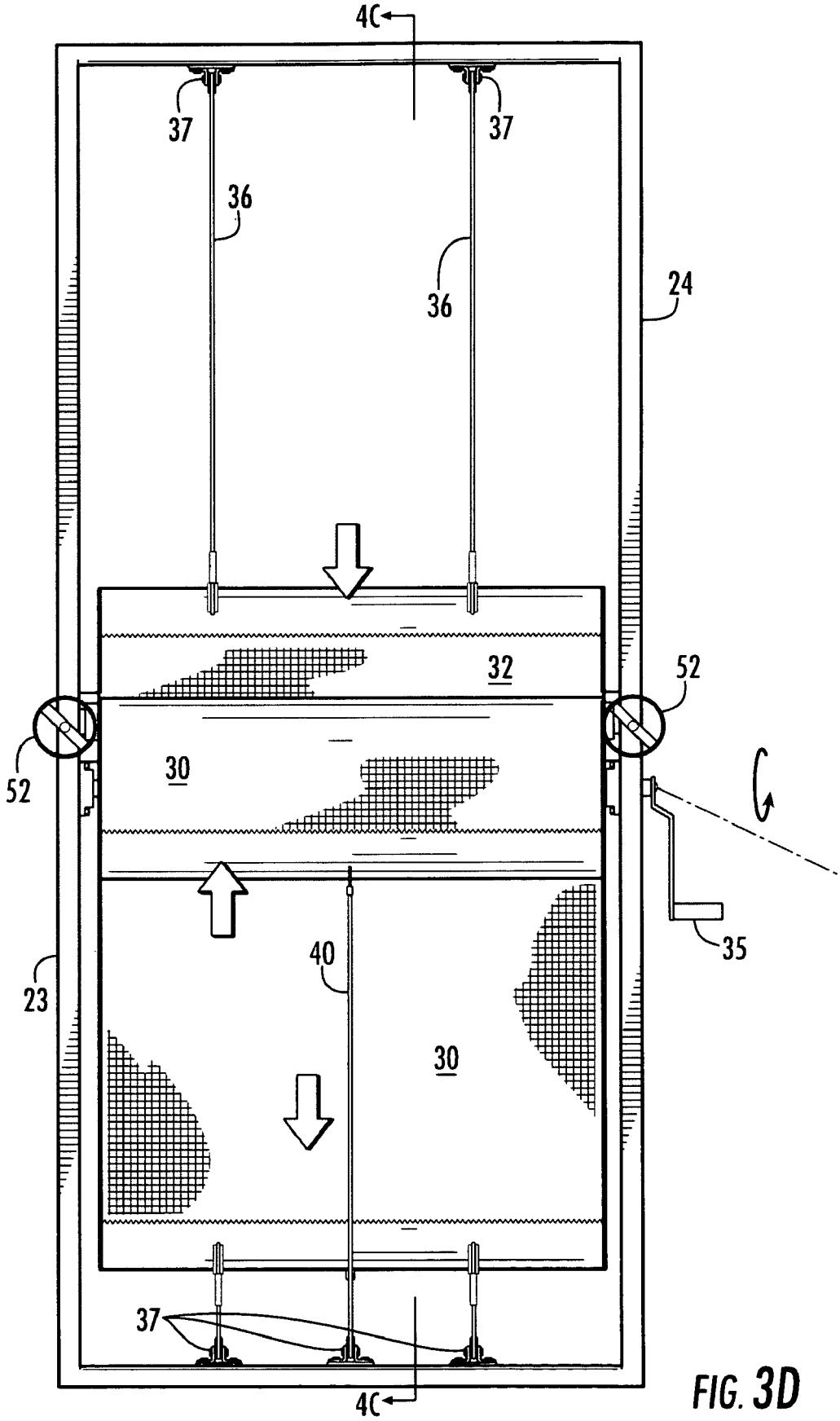
FIG. 3D is a rear elevation view of the apparatus with the slab roller in the intermediate position.

The operator continues turning the handle 35 in the same direction until the slab roller reaches the intermediate position shown in FIG. 3C. As illustrated in FIG. 4C, turning the handle 35 rotates the drive axle 34 to continue to move rear panel 32 and front panel 30 as previously described until shaft 39 supporting the forward end of the rear panel and the rearward end of the front panel is located adjacent the lower pulleys 37. In the intermediate position, shaft 41 supporting the forward end of front panel 30 is located adjacent the drive axle 34, but below front and rear idler rollers 31, 33, while shaft 38 supporting the rearward end of rear panel 32 is located above the idler rollers. As illustrated in FIG. 5B, the block of prepared clay PC is fully drawn into the gap G defined by the front panel 30 and the rear panel 32 in the intermediate position. FIG. 3D shows the intermediate position of the slab roller 20 from the rear view.

Figure 3E:
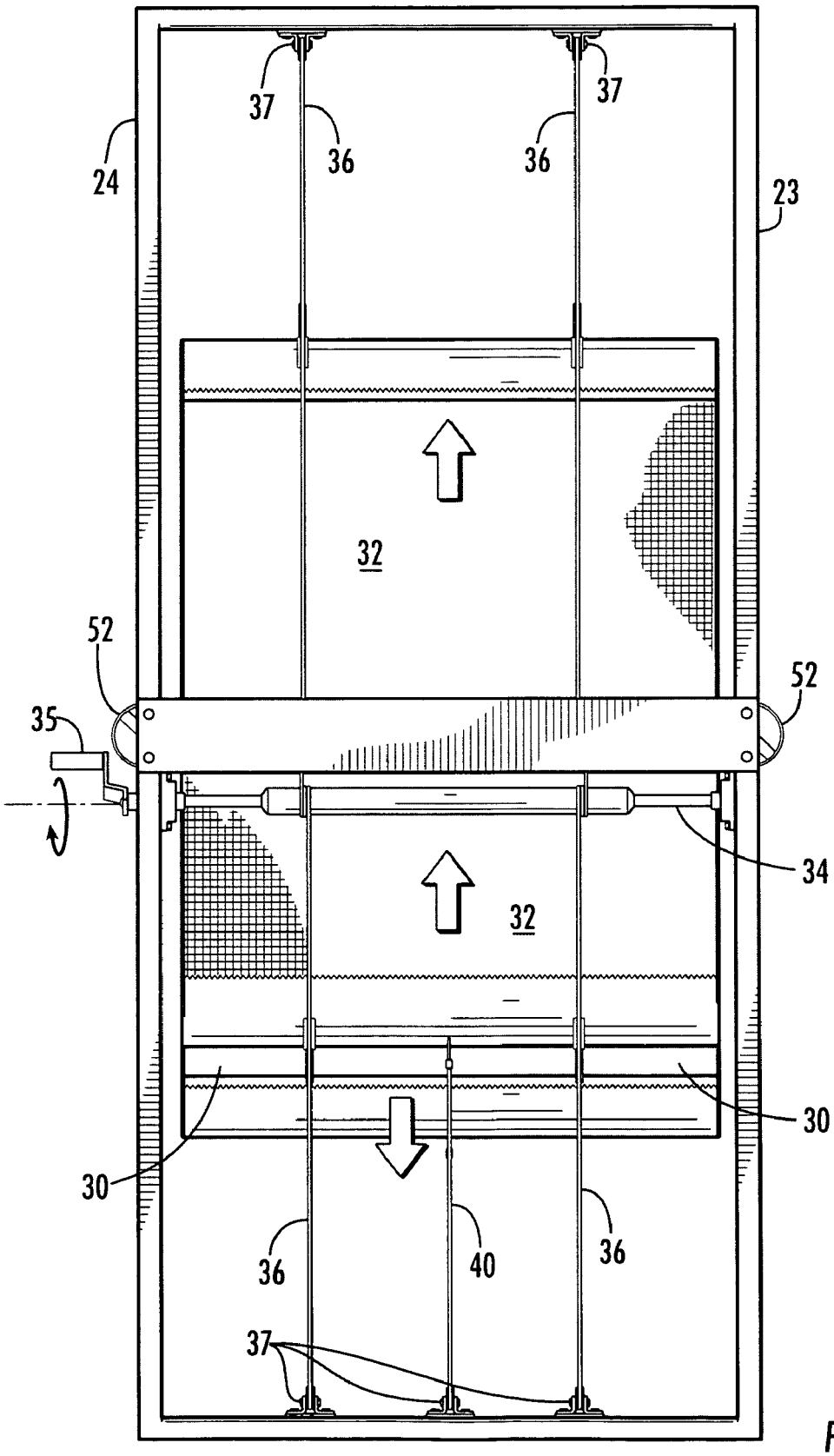
FIG. 3E is a rear elevation view of the apparatus illustrating the slab roller moving from the intermediate position back to the initial position.
Figure 3F:
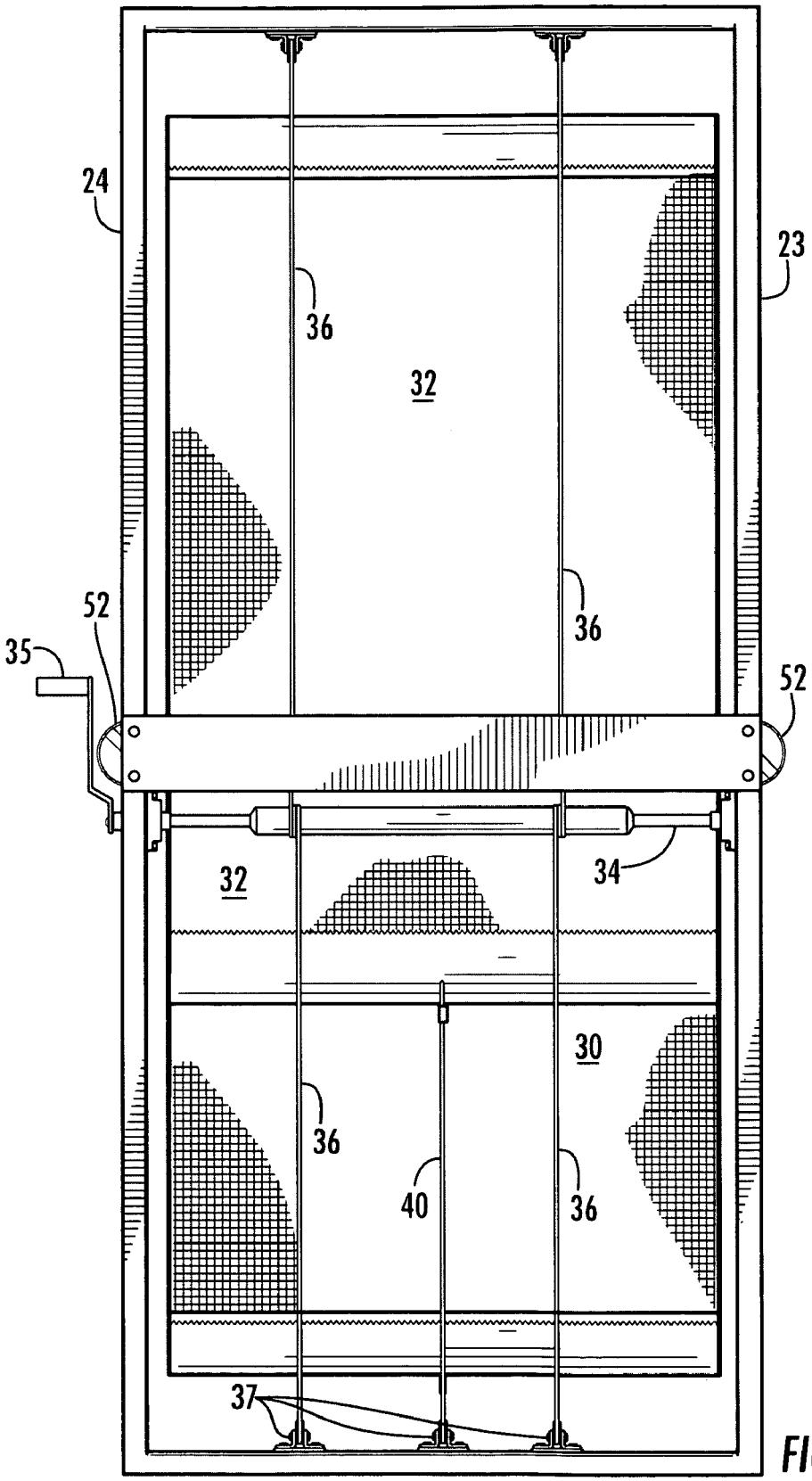
FIG. 3F is a rear elevation view of the apparatus with the slab roller in the initial position.

FIG. 3E and FIG. 3F illustrate movement of the slab roller 20 from the intermediate position back to the initial position. FIG. 5C shows the clay slab CS emerging from the gap G between the front panel 30 and the rear panel 32 as the slab roller 20 moves back to the initial position. The operator turns the handle 35 in the direction (i.e. clockwise) indicated by the arrow in FIG. 3E, which in turn causes the drive axle 34 to simultaneously wind and unwind the outer cables 36 as previously described. However, in this instance, the drive axle 34 rotates in the opposite direction and the outer cables 36 move in the opposite direction to raise the rear panel 32, while lowering the forward end of the front panel 30 relative to the rearward end of the front panel and the forward end of the rear panel. More specifically, the outer cables 36 apply a force to shaft 38 that moves rear panel 32 in the direction (i.e. upward) indicated by the arrows. At the same time, the force applied by shaft 39 to inner cable 40 moves the forward end of front panel 30 in the direction (i.e. downward) indicated by the arrow and the rearward end of the front panel 30 in the same direction (i.e. upward) indicated by the arrow as the rear panel 32.

Again, it should be noted that inner cable 40 is not driven by the drive axle 34, and instead merely guides the front panel 30, while maintaining it substantially taut. Furthermore, it should be noted with reference to FIG. 5C that front idler roller 31 and rear idler roller 33 are not directly driven by the operator turning handle 35 and instead merely apply pressure to the front panel 30 and the rear panel 32, respectively, during movement of the panels, as previously described. As a result, the clay slab CS is not driven out of the gap G by the idler rollers 31, 33, and instead is drawn (e.g. pulled) out of the gap G by the upward movement of front panel 30 and rear panel 32. Thus, the clay slab CS formed from the prepared clay PC does not exhibit a predetermined grain direction. Furthermore, there is no need to provide the front idler roller 31 or the rear idler roller 33 with a knurled or roughened exterior surface to grip the front panel 30 or the rear panel 32, respectively, in a positive manner. Thus, the clay slab CS will not have an uneven or rough exterior surface that can result in a finished piece of pottery, sculpture or artwork having an undesirable exterior surface. FIG. 3F shows the slab roller 20 returned to the initial position from the rear view. As will be readily apparent to those skilled in the art, a conventional power source, for example an electric motor, may be substituted for the manually-operated handle 35 to rotate the drive axle 34, and thereby automate operation of the slab roller 20. Finally, it should also be noted that the front panel 30 and the rear panel 32 are integrally attached to one another and aligned by the outer cables 36 and horizontal shafts 38, 39. The lengths of the outer cables 36 may be adjusted as necessary to maintain the alignment of the front panel 30 and the rear panel 32, and thereby prevent the clay slab from wandering off to one side during movement of the front and rear panels from the initial position to the intermediate position, and back again to the initial position.

Figure 6A:
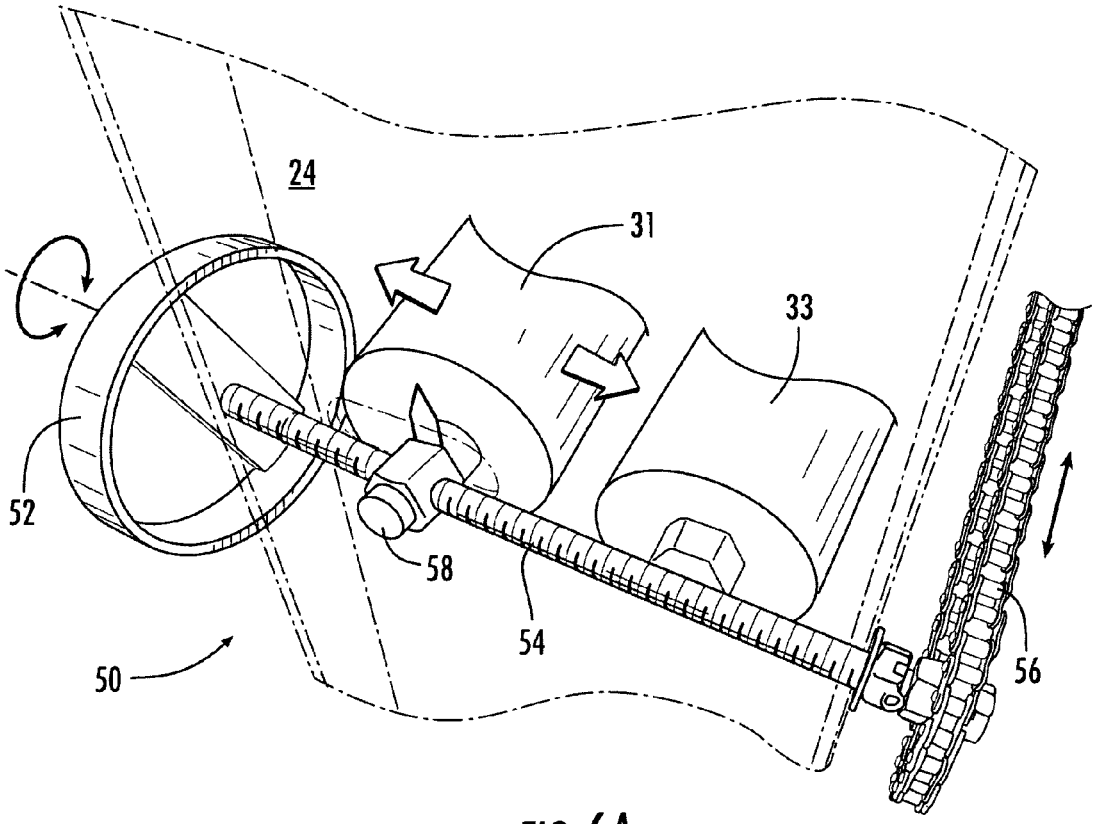
FIG. 6A is a detail perspective view showing a preferred embodiment of an adjustment mechanism for adjusting the distance between the front idler roller and the rear idler roller of the slab roller.
Figure 6B:
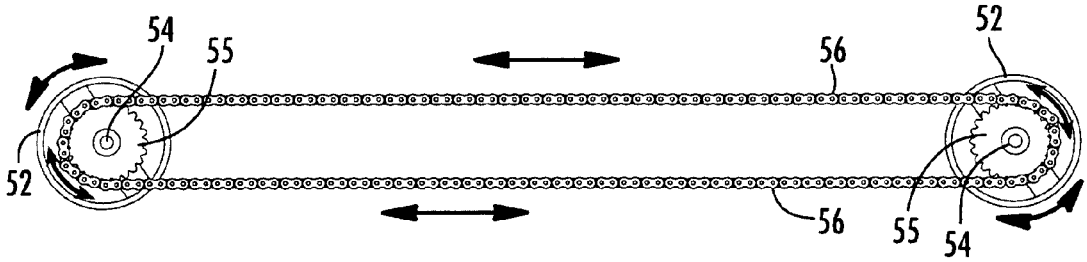
FIG. 6B is a detail rear view showing a portion of the adjustment mechanism.

FIG. 6A and FIG. 6B show a preferred embodiment of an adjustment mechanism, indicated generally at 50, for adjusting the distance between the front idler roller 31 and the rear idler roller 33 of the slab roller 20. As will be readily apparent, the distance between the idler rollers 31, 33 less the thickness of the front panel 30 and the thickness of the rear panel 32 determines the gap G for feeding the block of prepared clay PC. As shown and described herein, the front idler roller 31 is movable relative to the rear idler roller 33. However, the rear idler roller 33 may be configured to be movable relative to the front idler roller 31, or both idler rollers may be movable in opposite directions relative to one another, as desired. Regardless, the adjustment mechanism 50 comprises a rotatable actuator 52 rigidly connected to a screw drive 54 adjacent one of the side frame members 23, 24. As shown herein, the adjustment mechanism comprises a pair of actuators 52 each connected to a screw drive 54 adjacent one of the side frame members 23, 24. The ends of the screw drives 54 opposite the actuators 52 are provided with toothed gears 55 interconnected by a conventional chain 56. In this manner, adjustment mechanism 50 forms a drive system such that rotation of the actuators 52 and the screw drives 54 is synchronized. In other words, rotation of either actuator 52 will result in the same adjustment at both ends of front idler roller 31. If desired, the operator may disengage the synchronized actuators 52 (for example by rotatably coupling one of the gears 55 with the corresponding screw drive 54, or by removing the chain 56), and thereby produce a clay slab CS having a wedge-shape.

Figure 7A:
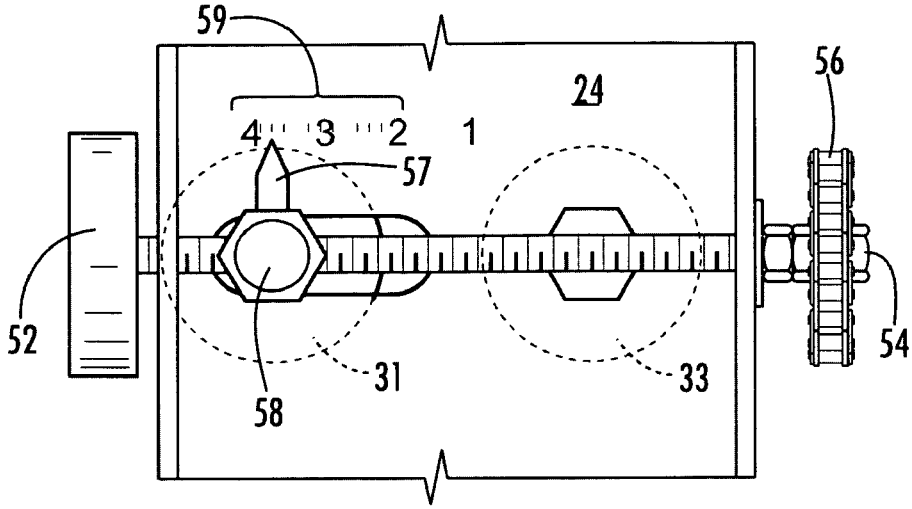
FIG. 7A is a detail side view of the adjustment mechanism illustrating the front idler roller of the slab roller in a first position relative to the rear idler roller.
Figure 7B:
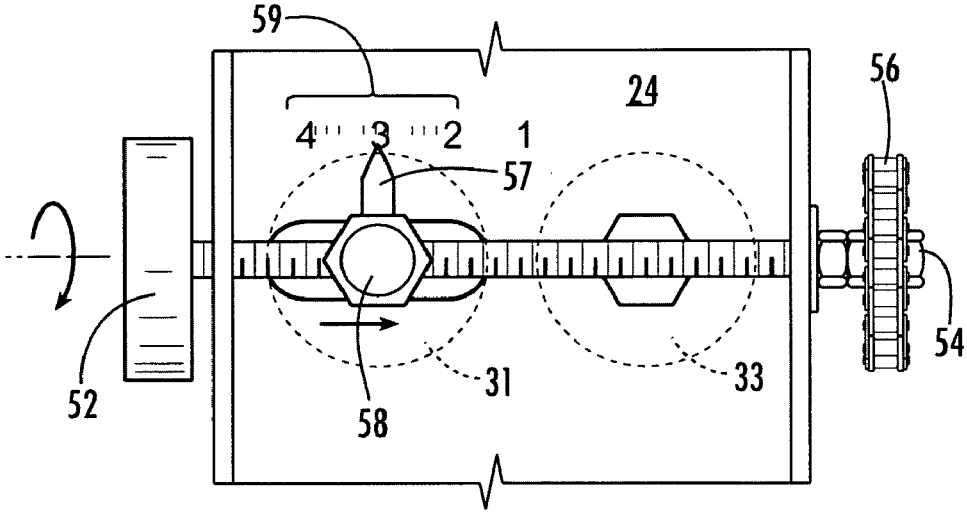
FIG. 7B is a detail side view of the adjustment mechanism illustrating the front idler roller of the slab roller moving from the first position to a second position relative to the rear idler roller.
Figure 7C:
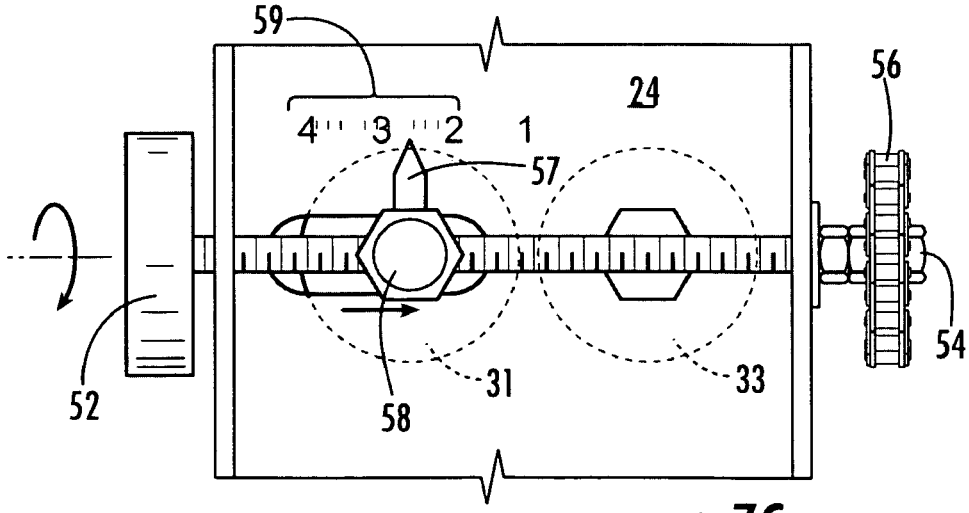
FIG. 7C is a detail view of the adjustment mechanism illustrating the front idler roller of the slab roller moving from the second position to a third position relative to the rear idler roller.

In particular, adjustment mechanism 50 comprises a traveler 58 mounted on each end of an inner shaft of the front idler roller 31. The traveler 58 is also movably mounted on the screw drive 54 such that rotation of the actuator 52 (rigidly connected to the screw drive) results in linear translation of the traveler on the screw drive, as indicated by the opposed arrows in FIG. 6A. Consequently, the distance between the front idler roller 31 and the stationary rear idler roller 33 can be adjusted by rotating either or both of the actuators 52. FIG. 7A shows the front idler roller 31 of the slab roller 20 in a first selected position relative to the rear idler roller 32. An optional scale 59 may be provided for selecting a predetermined distance between the idler rollers 31, 33. FIG. 7B illustrates use of the adjustment mechanism 50 to move the front idler roller 31 from the first selected position (i.e. 3.5 on scale 59) to a second selected position (i.e. 2.5 on scale 59). The operator rotates the actuator 5, and thus the screw drive 54, in a predetermined direction (i.e. clockwise) to drive the traveler 58, and thus the front idler roller 31, in the direction indicated by the arrow in FIG. 7B. FIG. 7C illustrates continued use of the adjustment mechanism 50 to move the front idler roller 31 relative to the rear idler roller 33 from the second selected position (i.e. 2.5 on scale 59) to a third selected position (i.e. 1.75 on scale 59) to reduce the gap G defined by the front panel 30 and the rear panel 32.

Figure 8A:
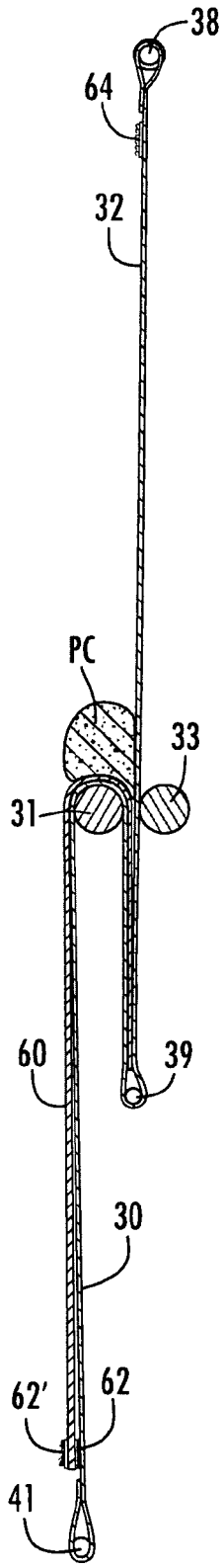
FIG. 8A is a partial sectional view showing a first embodiment of an intermediate panel in a first configuration relative to the front panel and the rear panel of the slab roller for forming a clay slab from prepared clay having a first characteristic, and in particular, a lighter hue.
Figure 8B:
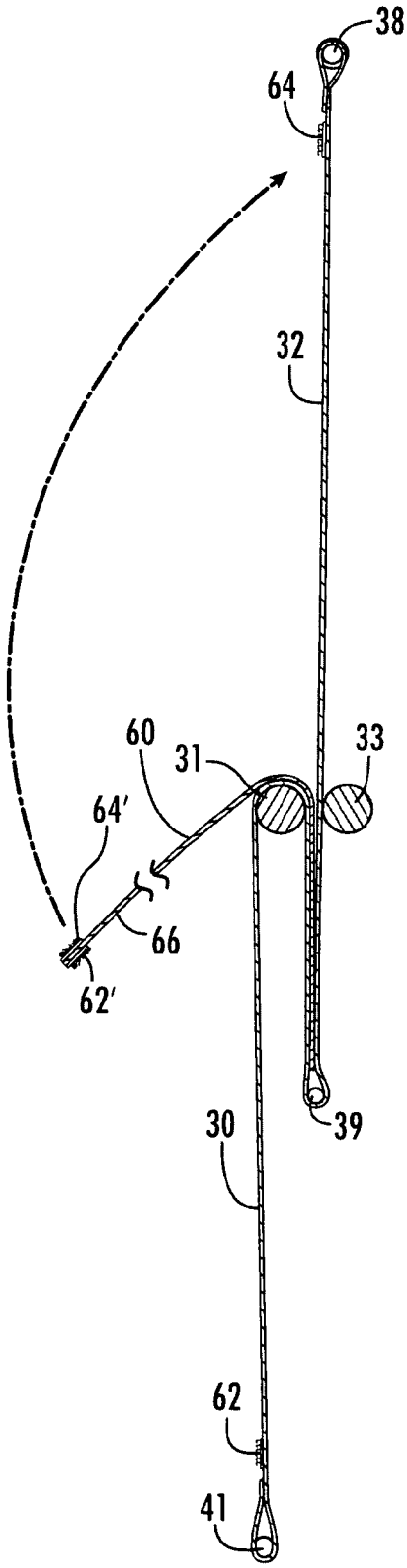
FIG. 8B is a partial sectional view showing the first embodiment of the intermediate panel moving from the first configuration to a second configuration relative to the front panel and the rear panel of the slab roller.
Figure 8C:
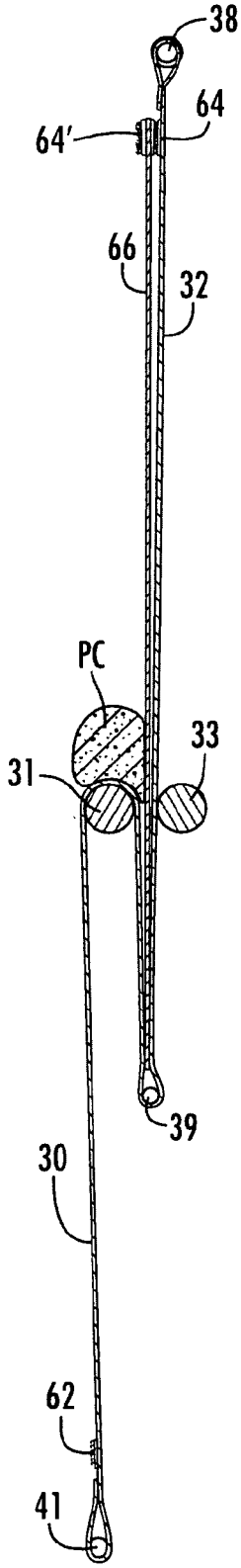
FIG. 8C is a partial sectional view showing the first embodiment of the intermediate panel in the second configuration relative to the front panel and the rear panel of the slab roller for forming a clay slab from prepared clay having a second characteristic, and in particular, a darker hue.

FIGS. 8A-8C show a first embodiment of an intermediate panel 60 for forming a clay slab CS from prepared clay PC having a first characteristic, such as a lighter hue. When forming multiple clay slabs CS from different colored blocks of prepared clay PC, the front panel 30 and the rear panel 32 may transfer color residue from one block of prepared clay to a subsequent block of prepared clay. Obviously, the transfer of color residue from a clay slab CS having a darker hue to a clay slab CS having a lighter hue can contaminate the finished piece of pottery, sculpture or artwork. Accordingly, the slab roller 20 of the invention provides an optional means for forming clay slabs CS having different hues. FIG. 8A shows an intermediate panel 60 in a first configuration relative to the front panel 30 and the rear panel 32 of the slab roller 20 for use with prepared clay PC having a first characteristic, and in particular, a lighter hue. The front panel 30 and the intermediate panel 60 comprise complimentary attachment means 62, 62', respectively, for removably attaching the intermediate panel to the front panel. Rear panel 32 and the intermediate panel 60 likewise comprise complimentary attachment means 64, 64', respectively, for removably attaching the intermediate panel to the rear panel. As shown in FIGS. 8A-8C, the complimentary attachment means 62, 62' and 64, 64' may be a hook-and-loop fastener, such as the commonly available Velcro®, which is a registered trademark belonging to Velcro Industries B.V., Antilles, Netherlands.

FIG. 8B shows the first embodiment of the intermediate panel 60 detached from the front panel 30 and moving from the first configuration to a second configuration relative to the front panel and the rear panel 32 of the slab roller 20. In the second configuration (FIG. 8C), the intermediate panel 60 is removably attached to the rear panel 32 by complimentary attachment means 64, 64'. FIG. 8C shows the first embodiment of the intermediate panel 60 in the second configuration relative to the front panel 30 and the rear panel 32 of the slab roller 20 for use with prepared clay PC having a second characteristic, and in particular, a darker hue. In the first configuration (FIG. 8A), the prepared clay PC, for example having a lighter hue, is drawn into the slab roller 20 between the front idler roller 31 and the rear idler roller 33 by the intermediate panel 60 and the rear panel 32, while the front panel 30 does not come into contact with the prepared clay. In the second configuration (FIG. 8C), the prepared clay PC, for example having a darker hue, is drawn into the slab roller 20 between the front idler roller 31 and the rear idler roller 33 by the front panel 30 and the opposite surface 66 of the intermediate panel 60, while the rear panel 32 does not come into contact with the prepared clay. As a result, the color residue from the prepared clay PC deposited on the opposite surface 66 of the intermediate panel 60 and the front panel 30 (e.g. FIG. 8C) does not contaminate the prepared clay PC that comes into contact with the intermediate panel 60 and the rear panel 32 (e.g. FIG. 8A), or visa-versa.

Figures 9A, 9B, 9C:
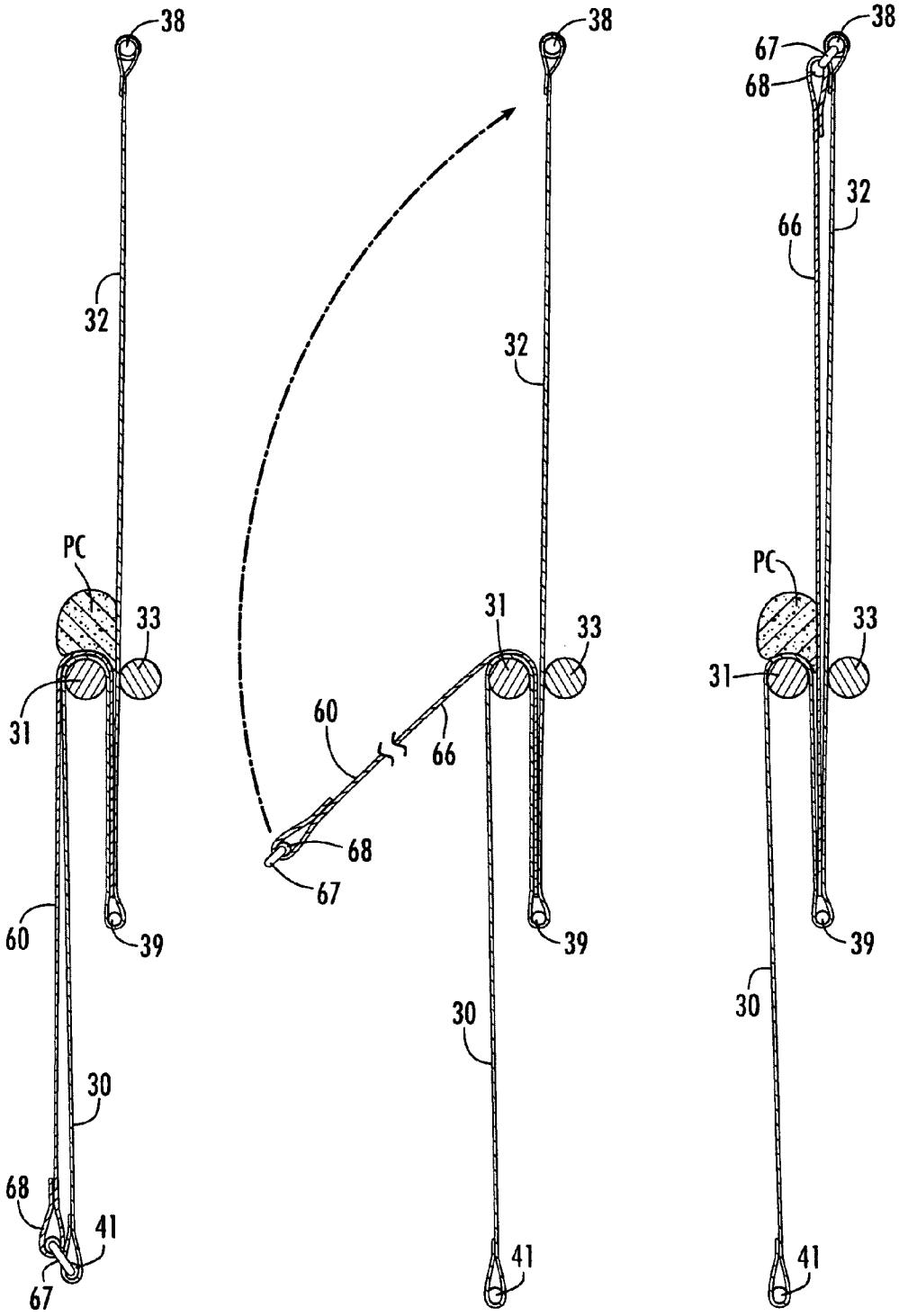
FIG. 9A is a partial sectional view showing a second embodiment of an intermediate panel in a first configuration relative to the front panel and the rear panel of the slab roller for forming a clay slab from prepared clay having the first characteristic.
FIG. 9B is a partial sectional view showing the first embodiment of the intermediate panel moving from the first configuration to a second configuration relative to the front panel and the rear panel of the slab roller.
FIG. 9C is a partial sectional view showing the first embodiment of the intermediate panel in the second configuration relative to the front panel and the rear panel of the slab roller for forming a clay slab from prepared clay having the second characteristic.
Figure 10:
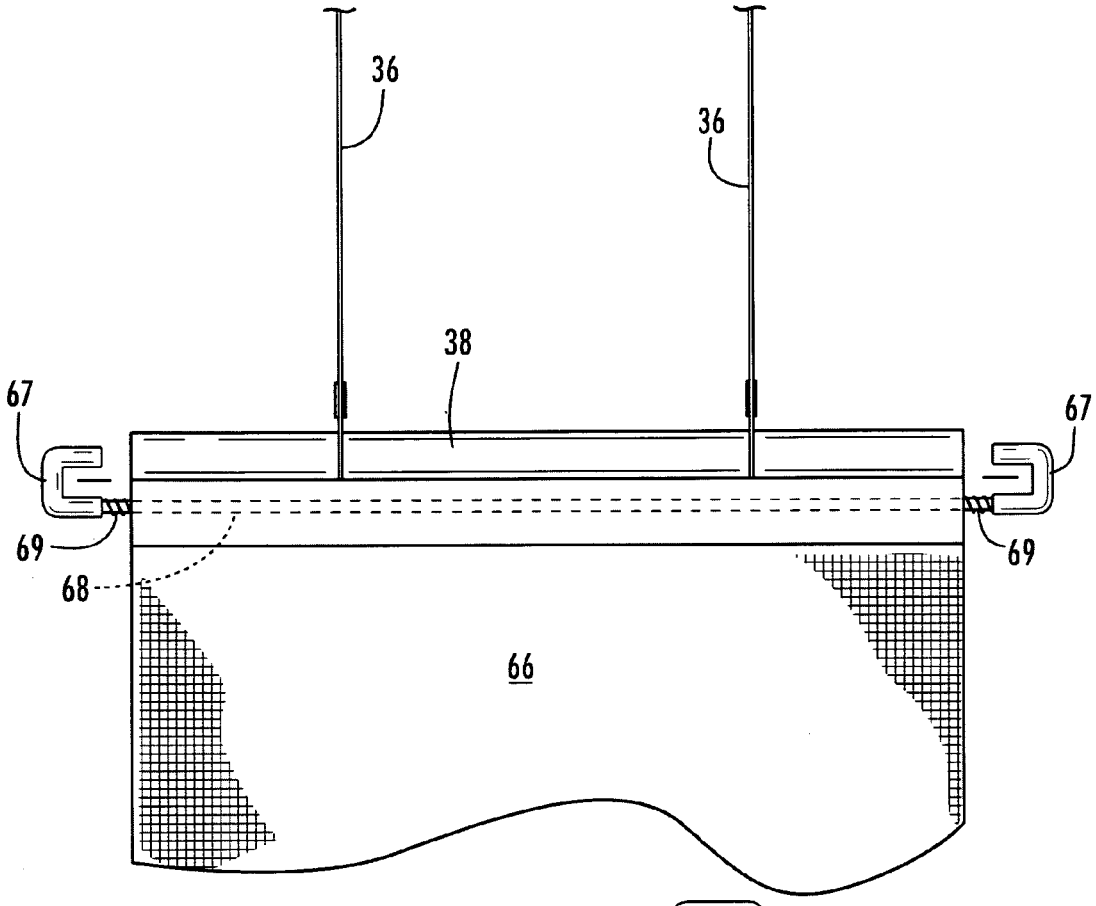
FIG. 10 is a partial elevation view showing the means for attaching the second embodiment of the intermediate panel to the front panel or the rear panel of the slab roller.

FIGS. 9A-9C and FIG. 10 show a second embodiment of an intermediate panel 60 for forming a clay slab CS from prepared clay PC having a first characteristic, such as a lighter hue. The second embodiment of the intermediate panel 60 likewise comprises opposite surface 66 for performing the function previously described, namely preventing color residue from the prepared clay PC deposited on the opposite surface 66 of the intermediate panel 60 and the front panel 30 from contaminating a clay slab CS formed by the intermediate panel 60 and the rear panel 32. The second embodiment of the intermediate panel 60, however, comprises a different type of attachment means for removably attaching the intermediate panel 60 to the front panel 30 (FIG. 9A) and alternatively to the rear panel 32. FIG. 9A shows the intermediate panel 60 in a first configuration relative to the front panel 30 and the rear panel 32 of the slab roller 20 for forming a clay slab from prepared clay PC having the first characteristic. The attachment means comprises at least one, and as shown herein, a pair of U-shaped hooks 67 movably disposed on the opposite ends of a horizontal shaft 68 provided at the free (i.e. movable) end of the intermediate panel 60. The hooks 67 are preferably biased inwardly relative to the shaft 68 by retaining springs 69 (FIG. 10). In this manner, each hook 67 can be urged outwardly from the shaft 68 against the biasing force of the corresponding retaining spring 69 and one leg of the hook positioned within a central opening provided on the shaft 41 of the front panel 30 (see FIG. 9A) or the shaft 38 of the rear panel 32 (see FIG. 9C). It should be noted that any one or more than one of the horizontal shafts 38, 39, 41, 68 may be formed as a hollow tube having sufficient stiffness to support the ends of the front panel 30, rear panel 32 and intermediate panel 60, as necessary to form a clay slab CS.

Figure 13:
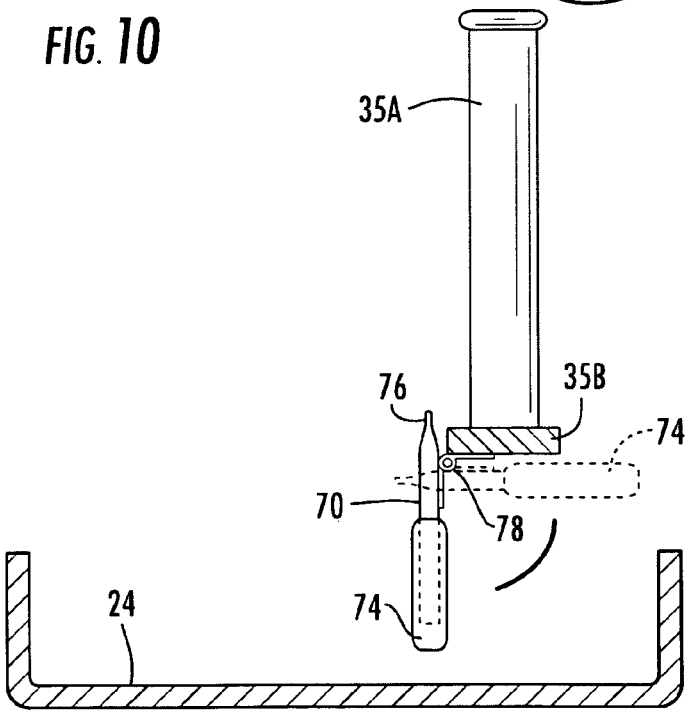
FIG. 13 is a top sectional view showing a third embodiment of a stop mechanism for retaining the slab roller in a desired position with the stop mechanism in an unlocked position indicated by broken lines and in a locked position indicated by solid lines.
Figure 11A:
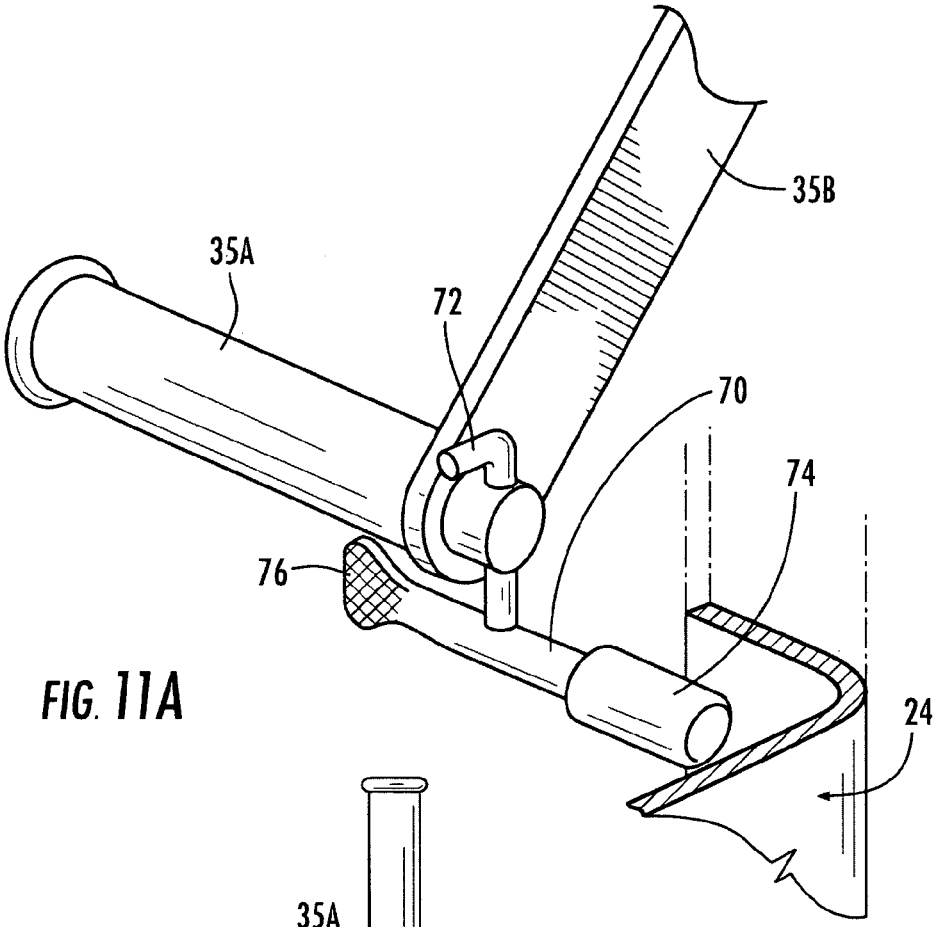
FIG. 11A is a detail perspective view showing a first embodiment of a stop mechanism for retaining the slab roller in a desired position with the stop mechanism in a locked position.
Figure 11B:
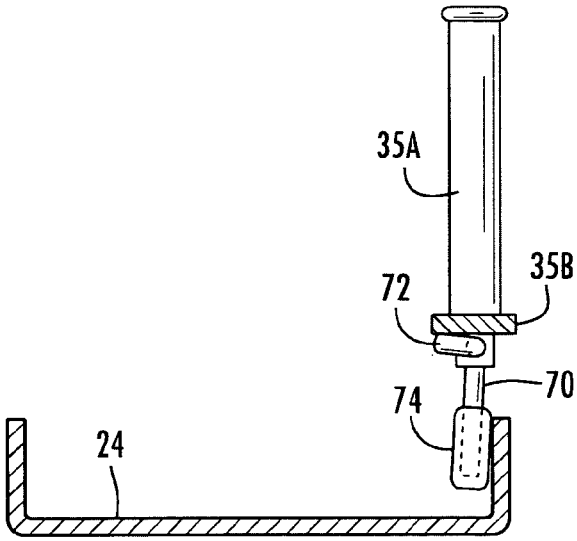
FIG. 11B is a top sectional view showing the first embodiment of the stop mechanism in the locked position.
Figure 11C:
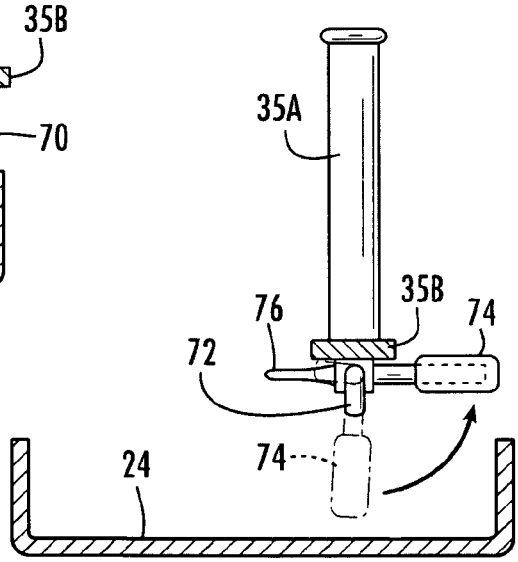
FIG. 11C is a top sectional view showing the first embodiment of the stop mechanism in an unlocked position.
Figure 12A:
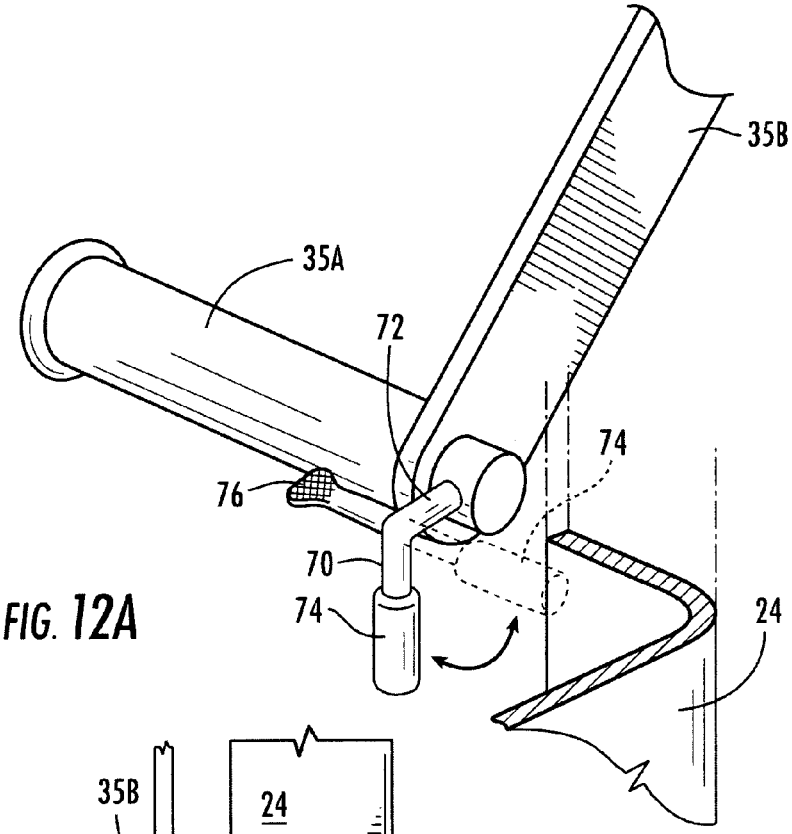
FIG. 12A is a detail perspective view showing a second embodiment of a stop mechanism for retaining the slab roller in a desired position with the stop mechanism in an unlocked position indicated by solid lines and in a locked position indicated by broken lines.
Figure 12B:
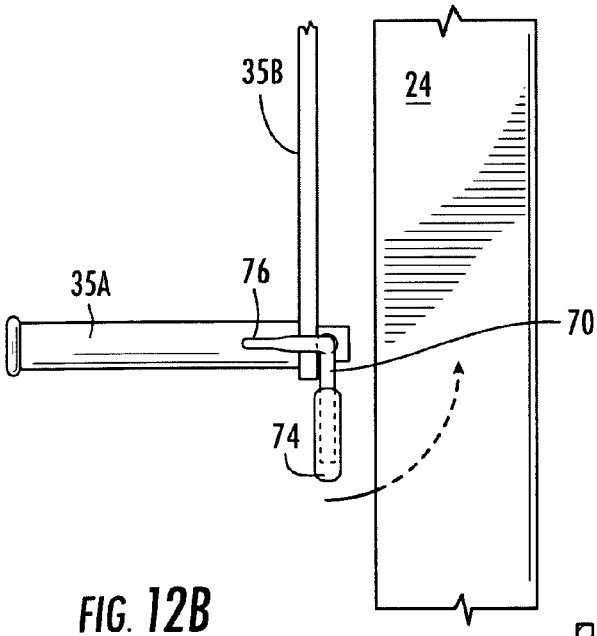
FIG. 12B is a partial side view showing the second embodiment of the stop mechanism in the unlocked position.
Figure 12C:
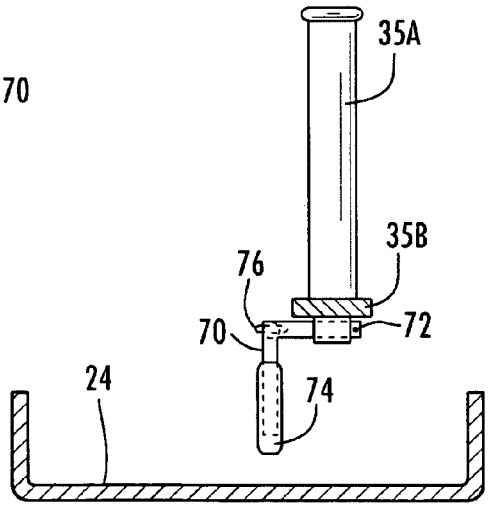
FIG. 12C is a top sectional view showing the second embodiment of the stop mechanism in the locked position.

FIGS. 11A-11C show a first embodiment of a stop mechanism for retaining the slab roller 20 in a desired position. FIGS. 12A-12C show a second embodiment of a stop mechanism for the same purpose. FIG. 13 shows a third embodiment of a stop mechanism for the same purpose. It is desirable, for example, to retain the slab roller 20 when it is back in the initial position after forming the clay slab CS from the prepared clay PC, as illustrated by FIG. 1C. Retaining the slab roller 20 in this position permits the operator to use both hands to remove the clay slab CS from the rear panel 32 without interference from the tendency of the rear panel to move downwardly under the influence of gravity due to the weight of the clay slab. FIG. 11A shows the first embodiment of the stop mechanism in a locked position in engagement with the side frame member 24 of the slab roller 20. The first embodiment of the stop mechanism comprises an actuator 70 attached to the handle 35 adjacent a grip portion 35A of the handle. As shown, the actuator 70 is movably attached to an extension portion 35B of the handle that spaces the grip portion 35A from the rotatable drive axle 34 that drives the outer cables 36, as previously described.

In the first embodiment, the actuator 70 comprises an L-shaped pin 72 for rotatably attaching the actuator to the handle 35 with a stop 74 at one end of the actuator and a lever 76 at the opposite end. An operator can press the lever 76 to move the actuator 70 between the locked position shown in FIGS. 11A and 11B and an unlocked position indicated by solid lines in FIG. 11C. The actuator 70 is restrained from moving to the unlocked position in one direction. Therefore, as illustrated in FIG. 11C, the operator first moves the handle 35 away from the side frame member 24 and then presses the lever 76 to rotate the actuator 70 and pin 72 relative to the handle 35 in the direction indicated by the solid arrow. The second embodiment of the stop mechanism is essentially identical to the first embodiment with the exception that the actuator 70 is curved or bent such that the stop 74 and the lever 76 are positioned at an angle relative to one another. As shown herein, the stop 74 and the lever 76 are disposed generally perpendicular to one another. As indicated by the double-headed arrow in FIG. 12A and the singe-headed arrow in FIG. 12B, the operator presses the lever 76 to rotate the stop 74 of the actuator 70 into the locked position for engagement with the side frame member 24, and then pulls the lever 76 in the opposite direction to rotate the actuator 70 relative to the handle 35 from the locked position to the unlocked position. The third embodiment of the stop mechanism is essentially identical to the first embodiment with the exception that the actuator 70 is movably attached to the extension portion 35B of the handle 35 adjacent the grip portion 35A by a conventional hinge 78. The hinge 78 permits the actuator 70 (and consequently stop 74) to rotate relative to the handle 35 between the unlocked position (shown in broken lines) and the locked position (shown in solid lines), as indicated by the double-headed arrow.

A slab roller 20 as shown and described herein is particularly useful for forming a clay slab CS from a block of prepared clay PC. A method according to the invention for working prepared clay PC into a relatively flat clay slab CS having a generally uniform thickness of the type used in making clay pottery, sculpture and artwork comprises providing a slab roller 20 that is oriented in a vertical direction. As previously described, the slab roller 20 comprises a frame 22, a front panel 30 movably supported on the frame and a rear panel 32 movably supported on the frame. The block of prepared clay PC is positioned on the slab roller 20 adjacent a gap G defined by the front panel 30 and the rear panel 32. The prepared clay PC is fed vertically into the slab roller 20 between the front panel 30 and the rear panel 32 by movement of the slab roller from an initial position to an intermediate position, and back again to the initial position. In particular, an operator rotates a handle 34 operatively coupled to a drive axle 34 in a predetermined direction (e.g. counter-clockwise) to simultaneously wind and unwind a pair of outer cable 36 about the drive axle. Rotation of the drive axle 34 causes the outer cables 36 to move the rear panel 32 and a rearward end of the front panel 30 in a downward direction, while at the same time moving a forward end of the front panel in an upward direction from the initial position to the intermediate position.

Once the intermediate position has been reached, the operator rotates the handle 35 in the opposite direction (e.g. clockwise) to simultaneously wind and unwind the outer cables 36 about the drive axle 34 in the other direction. Rotation of the drive axle 34 in the other direction causes the outer cables 36 to move the rear panel and the rearward end of the front panel 30 in an upward direction, while at the same time moving the forward end of the front panel in a downward direction from the intermediate position back to the initial position. The operator then removes the relatively flat clay slab CS having a generally uniform thickness from the rear panel 32 of the slab roller 20. The method of the invention draws (i.e. draws) the block of prepared clay PC between the front panel 30 and the rear panel 32, and thereby avoids the introduction of an undesirable grain direction in the clay slab CS, which may cause a shift or warp in a finished piece of clay pottery, sculpture or artwork.

The foregoing has described one or more exemplary embodiments of an apparatus and a method for forming a clay slab. More particularly, a slab roller and an associated method for working prepared clay into a relatively flat clay slab having a generally uniform thickness of the type used in making clay pottery, sculpture and artwork has been shown and described herein. In preferred embodiments the slab roller is oriented in a vertical direction and is configured to draw the prepared clay between opposed panels of a flexible material to form a relatively flat clay slab having a generally uniform thickness. While particular embodiments of the invention have been described, it will be apparent to those skilled in the art that various modifications thereto can be made without departing from the spirit and scope of the invention. Accordingly, the foregoing description of the preferred embodiments of the invention and the best mode for practicing the invention are provided for the purpose of illustration only, and not for the purpose of limitation. In particular, it will be appreciated that a slab roller in accordance with the invention may be applicable for use with a material other than prepared clay to form a relatively thin slab of the material having a generally uniform thickness. Furthermore, the slab roller may be oriented in a horizontal direction, if desired, with essentially the same features and advantages, without departing from the spirit and scope of the appended claims.

That which is claimed is:

1. An apparatus for forming a clay slab, comprising:

a frame oriented in a vertical direction relative to a horizontal floor;

a first panel made of a flexible material and movably supported on the frame;

a second panel made of a flexible material and movably supported on the frame, the first panel and the second panel disposed on the frame so as to define a gap therebetween adapted for forming the clay slab from a block of clay; and wherein the first panel and the second panel are oriented in the vertical direction.

2. An apparatus according to claim 1, wherein at least one of the first panel and the second panel is moved in the vertical direction to draw the block of clay into the gap to form the clay slab.

3. An apparatus according to claim 2, wherein the at least one of the first panel and the second panel is moved from an initial position to an intermediate position to draw the block of clay into the gap and is moved from the intermediate position back to the initial position to withdraw the clay slab from the gap.

4. An apparatus according to claim 3, further comprising a drive axle movably supported on the frame and operable for moving the at least one of the first panel and the second panel from the initial position to the intermediate position in a first direction and for subsequently moving the at least one of the first panel and the second panel from the intermediate position back to the initial position in a second direction opposite to the first direction.

5. An apparatus according to claim 1, further comprising a first cable having a first end attached to a first shaft supporting a first end of the second panel and a second end attached to a second shaft supporting a second end of the second panel and a first end of the first panel.

6. An apparatus according to claim 5, further comprising a second cable having a first end attached to the second shaft supporting the second end of the second panel and the first end of the first panel and a second end attached to a third shaft supporting a second end of the first panel.

7. An apparatus according to claim 6, wherein each of the first cable and the second cable are routed through at least one pulley provided on the frame.

8. An apparatus according to claim 2, further comprising a first idler roller for applying pressure to the first panel during the movement of the first panel and a second idler roller for applying pressure to the second panel during the movement of the second panel.

9. An apparatus according to claim 8, further comprising an adjustment mechanism for adjusting the distance between the first idler roller and the second idler roller to thereby determine the gap between the first panel and the second panel.

10. An apparatus for forming a clay slab, comprising:

a frame;

a planar first panel supported on the frame;

a planar second panel supported on the frame, the first panel and the second panel defining a gap therebetween for forming the clay slab, the first panel and the second panel being oriented in a vertical direction, the first panel and the second panel being configured for movement in a vertical direction relative to one another to form the clay slab;

a first idler roller for applying pressure to the first panel during a vertical movement of the first panel and a second idler roller for applying pressure to the second panel during a vertical movement of the second panel; and an adjustment mechanism for adjusting the distance between the first idler roller and the second idler roller to thereby determine the gap between the first panel and the second panel;

wherein the adjustment mechanism comprises an actuator rigidly connected to a screw drive and wherein one of the first idler roller and the second idler roller is movably coupled to the screw drive.

11. An apparatus according to claim 10, wherein the adjustment mechanism comprises a first actuator rigidly connected to a first screw drive with the one of the first idler roller and the second idler roller movably coupled to the first screw drive and a second actuator rigidly connected to a second screw drive with the one of the first idler roller and the second idler roller movably coupled to the second screw drive, and wherein the first actuator and the second actuator or the first screw drive and the second screw drive are operatively coupled to simultaneously move the one of the first idler roller and the second idler roller relative to the other of the first idler roller and the second idler roller.

12. An apparatus for forming a clay slab, comprising:

a frame;

a planar first panel supported on the frame;

a planar second panel supported on the frame, the first panel and the second panel defining a gap therebetween for forming the clay slab, the first panel and the second panel being oriented in a vertical direction; and a planar third panel that is movable between a first configuration wherein a first end of the third panel is fixedly attached to a first end of the first panel and removably attached to a second end of the first panel, and a second configuration wherein the first end of the third panel is removably attached to a first end of the second panel and fixedly attached to a second end of the second panel.

13. An apparatus according to claim 1, further comprising a stop mechanism for retaining the first panel and the second panel in a predetermined position.

14. An apparatus according to claim 13, wherein the stop mechanism comprises a stop configured for movement between an unlocked position and a locked position wherein the stop is in locking engagement with the frame.

15. A slab roller for forming a clay slab, comprising:

a frame oriented in a vertical direction and comprising a pair of side frame members, a lower frame member and an upper frame member, the frame defining a central opening;

a front panel disposed within the central opening and having a forward end and a rearward end;

a rear panel disposed within the central opening and having a rearward end and a forward end operatively coupled to the rearward end of the front panel;

at least one outer cable having an end attached to the rearward end of the rear panel and another end attached to the forward end of the rear panel and to the rearward end of the front panel;

an inner cable having an end attached to the forward end of the front panel and another end attached to the rearward end of the front panel; and a drive axle rotatably supported on the frame and configured to simultaneously wind and unwind the at least one outer cable about the drive axle and thereby move the front panel and the rear panel from an initial position wherein a block of prepared clay is disposed adjacent a gap defined between the front panel and the rear panel to an intermediate position wherein the block of prepared clay is drawn into the slab roller between the front panel and the rear panel, the drive axle being further configured to simultaneously wind and unwind the at least one outer cable about the drive axle in the opposite direction and thereby move the front panel and the rear panel from the intermediate position back to the initial position wherein the clay slab is disposed on one of the front panel and the rear panel.

16. A slab roller for forming a clay slab from a block of clay, comprising:

a frame comprising a pair of spaced apart side frame members oriented in a vertical direction relative to a horizontal floor, the side frame members separated by a lower frame member adjacent the floor and an upper frame member vertically spaced from the lower frame member;

a first panel made of a flexible material and supported on the frame, the first panel extending in the vertical direction from a position adjacent the lower frame member to a position intermediate of the lower frame member and the upper frame member;

a second panel made of a flexible material and supported on the frame, the second panel extending in the vertical direction from a position adjacent the upper frame member to the position intermediate of the lower frame member and the upper frame member; and wherein at least a portion of the first panel and the second panel define a gap therebetween configured for receiving the block of clay to form the clay slab.

17. A slab roller according to claim 16:

wherein the first panel and the second panel are each movably supported on the frame; and wherein the first panel is moved from the position adjacent the lower frame member towards the position intermediate of the lower frame member and the upper frame member, while the second panel is moved from the position adjacent the upper frame member towards the position intermediate of the lower frame member and the upper frame member to draw the block of clay into the gap between the first panel and the second panel.

18. A slab roller according to claim 17, wherein the first panel is moved back from the position intermediate of the lower frame member and the upper frame member towards the position adjacent the lower frame member, while the second panel is moved back from the position intermediate of the lower frame member and the upper frame member towards the position adjacent the upper frame member to withdraw the clay slab from the gap between the first panel and the second panel.

19. A slab roller according to claim 16, further comprising a first idler roller movably supported on the frame that engages the first panel and a second idler roller movably supported on the frame that engages the second panel opposite the first idler roller.

* * * * *